US008824932B2

(12) United States Patent
Masuda et al.

(10) Patent No.: US 8,824,932 B2
(45) Date of Patent: Sep. 2, 2014

(54) DEVELOPMENT DEVICE, AND PROCESS CARTRIDGE AND IMAGE FORMING APPARATUS INCORPORATING SAME

(75) Inventors: Katsumi Masuda, Kanagawa (JP); Takamasa Ozeki, Kanagawa (JP); Nobuyuki Taguchi, Kanagawa (JP); Yuuki Satoh, Kanagawa (JP); Toshiki Hayashi, Kanagawa (JP); Kyohta Koetsuka, Kanagawa (JP); Toshio Kojima, Kanagawa (JP); Masayuki Ohsawa, Kanagawa (JP); Noriyuki Kamiya, Kanagawa (JP); Takumi Terasaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 522 days.

(21) Appl. No.: 13/019,610

(22) Filed: Feb. 2, 2011

(65) Prior Publication Data

US 2011/0194874 A1 Aug. 11, 2011

(30) Foreign Application Priority Data

Feb. 10, 2010 (JP) ..... 2010-027208
Feb. 23, 2010 (JP) ..... 2010-036809

(51) Int. Cl.
*G03G 15/08* (2006.01)
*G03G 15/09* (2006.01)

(52) U.S. Cl.
CPC ..... *G03G 15/0818* (2013.01); *G03G 15/0921* (2013.01)
USPC ..... 399/254; 399/267

(58) Field of Classification Search
USPC ..... 399/254, 264, 265, 267, 272, 273, 276, 399/277
See application file for complete search history.

(56) References Cited

U.S. PATENT DOCUMENTS 7,043,182 B2 5/2006 Sakai et al.
7,599,650 B2 10/2009 Katoh et al.

(Continued)

FOREIGN PATENT DOCUMENTS

CN 101382761 A 3/2009
JP 2003-208027 7/2003

(Continued)

OTHER PUBLICATIONS

Chinese Office Action issued Apr. 19, 2012, in Patent Application No. 201110035563.0.

(Continued)

*Primary Examiner* — David Gray
*Assistant Examiner* — Erika J Villaluna
(74) *Attorney, Agent, or Firm* — Oblon, Spivak, McClelland, Maier & Neustadt, L.L.P.

(57) ABSTRACT

A development device includes a developer container, a developer carrier, exposed partly from a casing, facing a latent image carrier in a development area, a magnetic field generator inside the developer carrier, having multiple magnetic poles including a conveyance pole to convey the developer downstream from the development area to a developer release portion, a developer agitator, and a developer regulator. A predetermined gap is kept between an outer surface of the developer carrier and an inner wall of the casing downstream from an opening of the casing, upstream from a developer release portion, in a direction in which the developer carrier rotates. Multiple recesses are formed in the outer surface of the developer carrier at a pitch in a circumferential direction shorter than half a width of a magnetic flux density of the developer conveyance pole in a direction perpendicular to an axial direction of the developer carrier.

6 Claims, 17 Drawing Sheets

(56) References Cited

U.S. PATENT DOCUMENTS

| | | | |
|---|---|---|---|
| 7,813,680 | B2 | 10/2010 | Masuda et al. |
| 7,925,192 | B2 | 4/2011 | Kojima et al. |
| 2007/0127952 | A1 | 6/2007 | Terashima et al. |
| 2009/0060591 | A1 | 3/2009 | Kojima et al. |
| 2009/0245889 | A1 | 10/2009 | Koetsuka et al. |

FOREIGN PATENT DOCUMENTS

| | | |
|---|---|---|
| JP | 2009-80447 | 4/2009 |
| JP | 2009-244611 | 10/2009 |
| JP | 2009-251450 | 10/2009 |

OTHER PUBLICATIONS

Japanese Office Action issued Oct. 25, 2013, in Japan Patent Application No. 2010-027208.

Japanese Office Action issued Nov. 29, 2013, in Japan Patent Application No. 2010-036809.

DEVELOPMENT DEVICE, AND PROCESS CARTRIDGE AND IMAGE FORMING APPARATUS INCORPORATING SAME

CROSS-REFERENCE TO RELATED APPLICATIONS

This patent specification is based on and claims priority from Japanese Patent Application Nos. 2010-027208, filed on Feb. 10, 2010 and 2010-036809, filed on Feb. 23, 2010 in the Japan Patent Office, which are incorporated by reference herein in their entirety.

BACKGROUND OF THE INVENTION

1. Field of the Invention

The present invention generally relates to a development device used in an image forming apparatus such as a copier, a printer, a facsimile machine, or a multifunction machine capable of at least two of these functions, a process cartridge incorporating the development device, and an image forming apparatus incorporating the development device.

2. Description of the Background Art

In general, electrophotographic image forming apparatuses, such as copiers, printers, facsimile machines, or multifunction devices including at least two of those functions, etc., include a latent image carrier on which an electrostatic latent image is formed and a development device to develop the latent image with developer.

There are image forming apparatuses that employ a magnetic brush development method using two-component developer consisting essentially of toner and magnetic carrier. Development devices that employ the magnetic brush development method generally include a developer container such as a casing in which two-component developer is contained, an agitator such as a conveyance screw to transport the developer inside the casing, and a developer carrier such as a development roller. In the magnetic brush development method, the toner (i.e., toner particles) is electrostatically adsorbed to the carrier (i.e., carrier particles), and the development roller conveys the toner electrostatically attracted to the carrier to a development area, where the development roller is partly exposed through an opening formed in the casing of the development device and faces the image carrier. In the development area, the toner particles adhere to the latent image formed on the image carrier, thus developing it into a toner image.

For example, the developer carrier includes a cylindrical development sleeve, and a magnetic field generator such as a magnetic roller or multiple magnets are provided inside the development sleeve to generate magnetic fields for causing the developer (i.e., developer particles) to stand on end on and get piled on a surface of the development sleeve. More specifically, the carrier particles stand on end on the surface of the development sleeve along lines of magnetic force generated by the magnet roller, and the electrically charged toner particles adhere to the carrier particles, thus forming a magnetic brush. The magnet roller has multiple magnetic poles generated by multiple magnets shaped like bars, for example. The multiple magnetic poles includes an attraction pole for attracting the developer to the development sleeve, a main development pole for transferring the toner to the image carrier, and a release pole for releasing the developer from the development sleeve. In particular, the main development pole is provided at the same circumferential position as a position of the development sleeve that faces the development area. The developer that stands on end on the surface of the development sleeve can be transported circumferentially by rotating at least one of the development sleeve and the magnet roller.

Typically, to facilitate conveyance of the developer, the surface of the development sleeve is sandblasted or bead-blasted so as to form grooves or irregularities in its surface. In particular, development rollers having a grooved surface or irregular surface are widely used in multicolor image forming apparatuses such as copiers and printers for attaining high quality images. Abrading the surface of the development sleeve by forming grooves or sandblasting can prevent or reduce slippage of the developer on the surface of the development sleeve and accumulation of the developer thereon, thus preventing a decrease in image density resulting from it.

For example, JP-2009-80447-A proposes using a development sleeve having multiple recesses formed at regular intervals in the surface of the development sleeve. The density of the developer carried on this development sleeve is as dense as that carried on the sandblasted development sleeve having the irregular surface. Simultaneously, this development sleeve has an ability to transport the developer as high as that of the grooved development sleeve.

FIG. 30 is an enlarged view of an area of about 2 to 3 $cm^2$ of the surface of the development sleeve disclosed in JP-2009-80447-A, viewed from a side of the development device. As shown in FIG. 30, multiple small oval groves or recesses 139Z are formed in the surface of the development sleeve, and each recess 139Z is oblique to a rotary axial direction of the development sleeve with its left end tilted upward and its right end tilted downward. The small recesses 139Z are formed densely on the surface of the development sleeve with a cutting tool such as a tool bit by properly setting the rotational frequency of the bit, the velocity at which the bit is moved, and the rotational velocity of the development sleeve. When the development sleeve rotates downward in FIG. 30, the developer carried on the development sleeve is moved in the direction indicated by arrow Y1 shown in FIG. 30 in a developer release portion, where the developer is separated from the development sleeve, because the recesses 139Z are oblique to the rotary axial direction of the development sleeve. Thus, a force for transporting the developer to one end (in FIG. 30, to the left) of the development sleeve in the rotary axial direction is generated. When the force exerted by the development roller for transporting the developer is in the direction identical to the direction in which the agitator transports the developer while agitating it, the rotational frequency of the agitator can be reduced, thus reducing the energy. Alternatively, when the rotational frequency of the agitator is maintained, the concentration of the toner in the developer can become more uniform.

In such development devices, if the electrical charge of the toner is insufficient due to deterioration of the developer or because the toner is insufficiently mixed with the carrier, the toner cannot be adsorbed to the carrier sufficiently and might be separated from the carrier in the development area or a developer conveyance path through which the developer is conveyed to the development area and collected from the development area. As a result, the toner might leak out the development device and scatter inside or outside the image forming apparatus. In particular, in image forming apparatuses using removably installable development devices, it is preferred that the amount of scattering toner be minimized on the front side in a direction in which users or service persons insert the development device into the image forming apparatus because they also operate or visually check the apparatus there.

Another matter regarding such development devices is carry-over of developer, which is a phenomenon of the developer that is not separated from the developer carrier in the release portion but is carried further by the developer carrier. If the developer after image development, in which the concentration of toner is decreased, is not returned to the developer container but is carried over and supplied again to the development area, image density can become uneven.

SUMMARY OF THE INVENTION

In view of the foregoing, in one illustrative embodiment of the present invention, a development device development includes a casing, a developer container housed in the casing, for containing two-component developer consisting essentially of toner and carrier, a hollow, cylindrical nonmagnetic developer carrier rotatably disposed within the casing, to transport the developer while rotating, a magnetic field generator disposed inside the developer carrier, a developer agitator disposed in the developer container, to agitate the developer while transporting the developer in an axial direction of the developer carrier; and a developer regulator housed in the casing, to adjust a layer thickness of the developer carried on the developer carrier. The developer carrier is exposed partly through an opening of the casing and facing the latent image carrier in a development area. The magnetic field generator has multiple magnetic poles including an attraction pole to attract the developer from the developer container to the developer carrier, a developer conveyance pole to keep the developer on the developer carrier downstream from the development area in a direction in which the developer carrier rotates to a developer release portion, and a release pole to separate the developer from the developer carrier and to return the developer to the developer container.

A predetermined gap is kept between an outer circumferential surface of the developer carrier and an inner wall of the casing at a portion downstream from the opening formed in the casing and upstream from the developer release portion in the direction in which the developer carrier rotates. Multiple recesses are formed in the outer circumferential surface of the developer carrier at intervals, and a pitch between adjacent recesses in a circumferential direction of the developer carrier is shorter than half a width of a magnetic flux density of the developer conveyance pole in a direction perpendicular to an axial direction of the developer carrier.

Another illustrative embodiment of the present invention provides a process cartridge removably installable in an image forming apparatus. The development device described above and at least one of the latent image carrier, a charging device, and a cleaning device are housed in a common casing.

Yet another illustrative embodiment provides an image forming apparatus that uses the above-described process cartridge.

In yet another illustrative embodiment of the present invention, a development device includes a developer container housed in a casing, a hollow, cylindrical nonmagnetic developer carrier rotatably disposed in the casing, to transport the developer while rotating, a first magnetic field generator disposed inside the developer carrier, a developer agitator disposed in the developer container, to agitate the developer while transporting the developer in an axial direction of the developer carrier, a developer regulator housed in the casing, to adjust a layer thickness of the developer carried on the developer carrier, and a second magnetic field generator positioned in a first end portion of the development device on a first side of the development device in the axial direction of the developer carrier. The developer carrier is exposed partly through an opening of the casing and facing the latent image carrier in a development area. The first magnetic field generator has multiple magnetic poles including an attraction pole to attract the developer from the developer container to the developer carrier, a developer conveyance pole to keep the developer on the developer carrier downstream from the development area in a direction in which the developer carrier rotates to a developer release portion, and a release pole to separate the developer from the developer carrier.

Multiple oval recesses are formed in the outer circumferential surface of the developer carrier at intervals, and a long axis of each of the multiple recesses is positioned oblique to the axial direction of the developer carrier such that a first longitudinal end thereof on the first side of the development device is positioned upstream in the direction in which the developer carrier rotates from a second longitudinal end thereof opposite the first longitudinal end for transporting the developer in a direction parallel to the axial direction of the developer carrier toward the first side of the development device as the developer carrier rotates. The second magnetic field generator generates a magnetic field for inhibiting the developer in the developer release portion from being moved in the direction toward the first side of the development device by the multiple recesses.

Yet another illustrative embodiment of the present invention provides a process cartridge removably installable in an image forming apparatus. The development device described above and at least one of the latent image carrier, a charging device, and a cleaning device are housed in a common casing.

Yet another illustrative embodiment provides an image forming apparatus that uses the above-described process cartridge.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
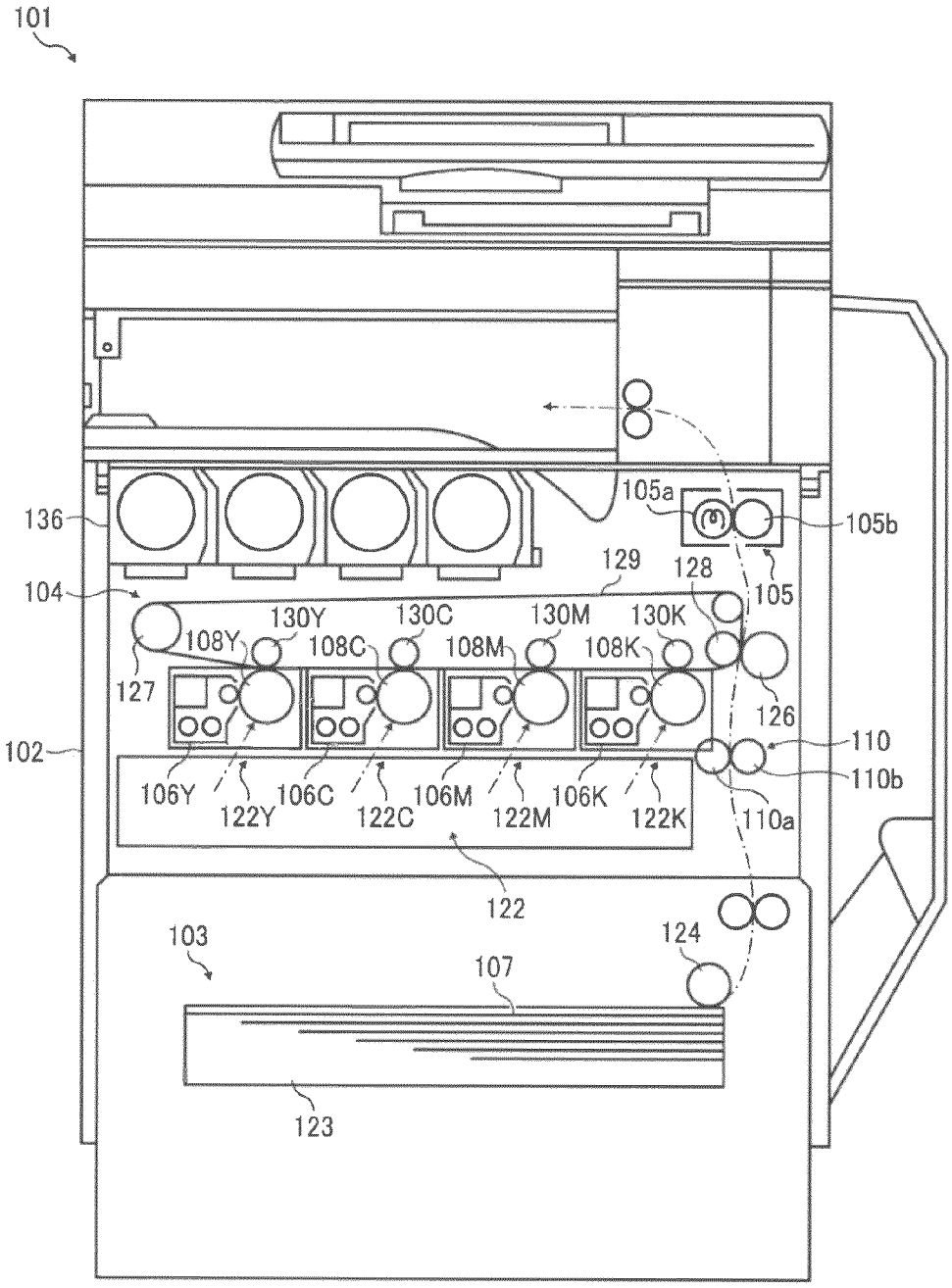
FIG. 1 is a diagram that illustrates a configuration of the image forming apparatus according to the present embodiment viewed from a front side thereof.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an illustrative embodiment of the present invention is described.

FIG. 1 is a diagram that illustrates a configuration of the image forming apparatus according to the present embodiment viewed from a front side thereof.

Referring to FIG. 1, an image forming apparatus 101 is a tandem image forming apparatus, such as a copier, that uses an intermediate transfer belt 129 and forms a multicolor image on a recording sheet 107 by superimposing yellow (Y), magenta (M), cyan (C), and black (K) single-color images one on another. It is to be noted that that the suffixes Y, M, C, and K attached to the end of each reference numeral indicate only that components indicated thereby are used for forming yellow, magenta, cyan, and black images, respectively, and hereinafter may be omitted when color discrimination is not necessary.

Referring to FIG. 1, an image forming apparatus 101 includes a main body 102, a sheet feeder 103, a pair of registration rollers 110*a* and 110*b* (hereinafter also simply "the pair of registration rollers 110"), an intermediate transfer unit 104, a transfer roller 126, a fixing device 105, multiple laser writing units 122Y, 122M, 122C, and 122K, and multiple process cartridges 106Y, 106M, 106C, and 106K.

The main body 102 is shaped like a box, for example, and is installed on the floor. The main body 102 contains the sheet feeder 103, the pair of registration rollers 110, the intermediate transfer unit 104, the fixing device 105, the multiple laser writing units 122Y, 122M, 122C, and 122K, and the multiple process cartridges 106Y, 106M, 106C, and 106K.

For example, multiple sheet feeders 103 are provided in a lower portion of the main body 102. Each sheet feeder 103 contains multiple recording sheets 107 and is provided with a sheet cassette 123 that can be pulled out from and retracted into the main body 102 and a feed roller 124. The feed roller 124 is pressed against the recording sheet 107 on the top in the sheet cassette 123. The feed roller 124 picks up and feeds the recording sheet 107 on the top to the pair of registration rollers 110.

The pair of registration rollers 110 is positioned in a conveyance path through which the recording sheet 107 is fed from the sheet feeder 103 to the transfer roller 126. The pair of registration rollers 110 clamps the recording sheet 107 therein and then forwards the recording sheet 107 to the transfer roller 126, timed to coincide with the arrival of an image to be transferred onto the recording sheet 107.

The intermediate transfer unit 104 is provided above the process cartridges 106Y, 106M, 106C, and 106K. The intermediate transfer unit 104 includes a driving roller 128, a driven roller 127, the intermediate transfer belt 129, and intermediate transfer rollers 130Y, 130M, 130C, and 130K. The driving roller 128 is positioned facing the transfer roller 126 via the intermediate transfer belt 129 and driven by a driving source such as a motor. The driven roller 127 is rotatably supported by the main body 102. The intermediate transfer belt 129 is an endless belt and stretched around the driving roller 128 and the driven roller 127. As the driving roller 128 rotates, the intermediate transfer belt 129 rotates around the driving roller 128 and the driven roller 127 counterclockwise in FIG. 1.

Each intermediate transfer roller 130 is positioned facing via the intermediate transfer belt 129 a photoconductor drum 108 included in the corresponding process cartridge 106. Yellow, magenta, cyan, and black toner images formed by the respective process cartridges 106 are transferred primarily from the respective photoconductor drums 108 by the respective intermediate transfer rollers 130 of the intermediate transfer unit 104 and superimposed one on another on the intermediate transfer belt 129, thus forming a multicolor toner image. The intermediate transfer belt 129 transports the multicolor toner image to the transfer roller 126, and the transfer roller 126 secondarily transfers the multicolor toner image onto the recording sheet 107. The transfer roller 126 forwards the recording sheet 107 onto which the toner image is transferred to the fixing device 105.

The fixing device 105 is positioned downstream from the transfer roller 126 in the direction in which the recording sheet 107 is transported and includes a pair of rollers 105*a* and 105*b* that clamps the recording sheet 107 therebetween. The fixing device 105 fixes the toner image on the recording sheet 107 transported from the transfer roller 126, clamped between the rollers 105*a* and 105*b*, with heat and pressure.

The laser writing units 122 are provided beneath the process cartridges 106. The laser writing units 122Y, 122M, 122C, and 122K correspond to the process cartridges 106Y, 106M, 106C, and 106K, respectively. Each laser writing unit 122 directs a laser beam onto the surface of the photoconductor drum 108 in the corresponding process cartridge 106, thus forming an electrostatic latent image, after a charge roller 109 charges the surface of the photoconductor drum 108 uniformly.

The process cartridges 106 is positioned between the intermediate transfer unit 104 and the respective laser writing units 122. The process cartridges 106 are removably insertable into the main body 102. The process cartridges 106 are arranged in parallel to each other in the direction in which the intermediate transfer belt 129 rotates.

Figure 2:
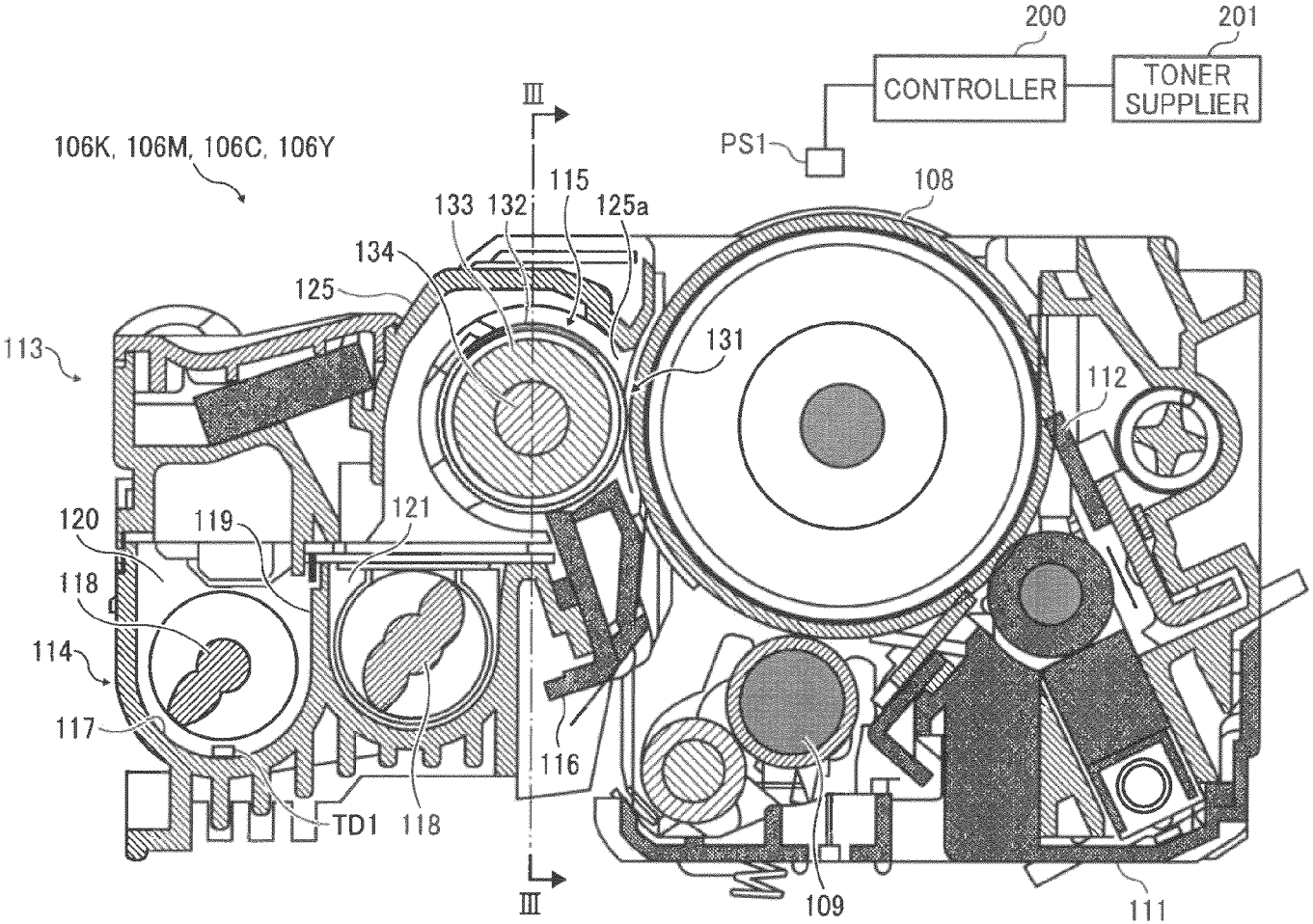
FIG. 2 is an end-on axial view of a development device according to an illustrative embodiment, installed in the image forming apparatus.

FIG. 2 is an end-on axial view of a development device according to an illustrative embodiment, installed in the image forming apparatus.

As shown in FIG. 2, each process cartridge 106 includes a cartridge casing 111, the charge roller 109 serving as a charging device, the photoconductor drum 108, a cleaning blade 112 serving as a cleaning member, and a development device 113.

The cartridge casing 111 is removably insertable into the main body 102 and houses the charge roller 109, the photoconductor drum 108, the cleaning blade 112, and the development device 113. The charge roller 109 charges the surface of the photoconductor drum 108 uniformly. The photoconductor drum 108 is positioned across a predetermined gap from a development roller 115 of the development device 113. The photoconductor drum 108 is columnar and rotatable about an axis of rotation. As described above, the electrostatic latent image is formed by the corresponding layer writing unit 122 on the surface of each photoconductor drum 108. The development device 113 supplies toner to the electrostatic latent image formed on the surface of each photoconductor drum 108, thus developing it into the toner image. The photoconductor drum 108 rotates and conveys the toner image to a portion facing the intermediate transfer belt 129, and then the toner image is transferred onto the intermediate transfer belt 129. The cleaning blade 112 removes any toner remaining on the surface of the photoconductor drum 108 after image transfer.

As shown in FIG. 2, the development device 113 includes a casing 125, a developer supply unit 114, the development roller 115 serving as a developer carrier, and a doctor blade 116 serving as a developer regulator. The development roller 11 includes a development sleeve 132 on its outer circumferential side.

Image formation performed by the image forming apparatus 101 is described below.

Initially, the photoconductor drum 108 starts rotating, and the charge roller 107 charges the surface of the photoconductor drum 108 uniformly to an electrical potential of −700 V, for example. Then, the laser writing units 122 direct the laser beams onto the surfaces of the respective photoconductor drums 108, thus attenuating the exposed portion (i.e., image portion) of each photoconductor drums 108 to an electrical potential of −150 V, for example. Accordingly, electrostatic latent images are formed on the respective photoconductor drums 108. When the latent image is conveyed to a development area 131 (shown in FIG. 2) as the photoconductor drum 108 rotates, a development bias of −550 V, for example, is applied to the latent image, thereby transferring the developer carried on the development sleeve 132 of the development device 113 to the photoconductor drum 108. Thus, the latent image formed thereon is developed into a toner image. The toner images formed on the photoconductor drums 108 in the process cartridges 106 are transferred by the respective intermediate transfer rollers 130 and superimposed one on another on the intermediate transfer belt 129, thus forming a multicolor toner image.

The multicolor toner image is then transferred onto the recording sheet 107 when the recording sheet 107 fed from the sheet feeder 103 by the feed roller 124 arrives at a position where the intermediate transfer belt 129 faces the transfer roller 126. The image is fixed by the fixing device 105 on the recording sheet 107, and thus the image forming apparatus 101 forms the multicolor image thereon.

Meanwhile, any toner remaining on the photoconductor drum 108 is removed by the cleaning blade 112, and the photoconductor drum 108 is prepared for subsequent image formation.

Additionally, the image forming apparatus 101 performs process control for reducing fluctuations in image quality due to changes in environmental conditions, deterioration of the components or developer over time, and the like. More specifically, the developability of the development device 113 is detected. For example, a given toner pattern is formed on the photoconductor drum 108 or the intermediate transfer belt 129 with the development bias kept constant, and the toner pattern is detected with a photosensor PS1 (shown in FIG. 2). The developability can be recognized based on changes in the image density of the toner pattern. Image quality can be kept constant by adjusting a target value of concentration of toner in the developer so that the developability is adjusted to a predetermined target value. For example, if the image density of the toner pattern detected by the photosensor PS1 is lower than the target image density, a controller 200 (shown in FIG. 2) of the image forming apparatus controls a toner supplier 201 that supplies fresh toner to the development device 113 so that the concentration of toner in the developer is adjusted to the target value. The controller 200 includes a central processing unit (CPU). By contrast, if the image density of the toner pattern detected by the photosensor PS1 is higher than the target image density, the controller 200 causes the development device 113 to develop the image, thereby reducing the concentration of toner in the developer in the development device 113. The concentration of toner in the developer can be detected with a toner concentration detector TD1 provided inside or outside the development device 113.

The development device 113 is described in further detail below.

The developer supply unit 114 includes a developer container 117 and a pair of agitation screws 118 serving as developer agitators. For example, the developer container 117 is shaped like a box and has an axial length (i.e., a length in its longitudinal direction) similar to an axial length of the photoconductor drum 108. Additionally, a partition 119 extending in the longitudinal direction is provided inside the developer container 117. The partition 119 divides the developer container 117 into a first compartment 120 and a second compartment 121 that communicate with each other in both end portions in the longitudinal direction.

The developer is contained in both the first compartment 120 and the second compartment 121 of the developer container 117. The developer used in the present embodiment is two-component developer consisting essentially of toner particles and magnetic particles (also "magnetic powder"). Fresh toner is supplied as required by the toner supplier 201 to one of axial end portions of the first compartment 120, which is positioned farther from the development roller 115 than the second compartment 121 is. For example, toner particles are spherical fine particles produced through an emulsion polymerization method or a suspension polymerization method. It is to be noted that, alternatively, toner may be produced by smashing synthetic resin blocks in which various colorants and pigments are mixed or dispersed. The toner particles have a mean particle diameter of within a range from about 3 μm to 7 μm.

A preferable toner for the present embodiment can be produced as follows: At least polyester prepolymer having a functional group including a nitrogen atom, polyester, colorant, and a release agent are dispersed in an organic solvent, thus producing a toner material solution. Then, the toner is produced through at least one of cross-linking and elongation reaction of the toner material solution in a aqueous medium.

The magnetic carrier is contained in both the first and second compartments 120 and 121. The magnetic carrier particles have a mean particle diameter of within a range from about 20 μm to 50 μm.

The agitation screws 118 are provided in the first and second compartments 120 and 121, respectively. The long axes of the agitation screws 118 parallel the longitudinal direction of the developer container 117, the development roller 115, and the photoconductor drum 108. Each agitation screw 118 is rotatable about an axis of rotation. Each agitation screw 118 mixes the toner with the magnetic carrier and transports the developer in the axial direction while rotating.

In the configuration shown in the figures, the agitation screw 118 in the first compartment 120 transports the developer from the axial end portion to which the toner is supplied to the other axial end portion. The agitation screw 118 in the second compartment 121 transports the developer in the opposite direction to the direction in which the developer is transported (hereinafter "developer conveyance direction") in the first compartment.

In the above-described configuration, while mixing the supplied toner and the magnetic carrier, the developer supply unit 114 transports the toner supplied to the end portion of the first compartment 120 to a downstream end portion in the developer conveyance direction and further to an upstream end portion of the second compartment 121 in the developer conveyance direction therein. The developer supply unit 114 further agitates the toner and the magnetic carrier in the second compartment 121 and then supplies the developer to the surface (i.e., the circumferential surface) of the development roller 115 while transporting it in the axial direction.

The casing 125 is box-shaped and is attached to the developer container 117 of the developer supply unit 114. The casing 125 and the developer container 117 together cover the development roller 115 and the like. Additionally, an opening 125*a* is provided in a portion of the casing 125 facing the photoconductor drum 108.

The development roller 115 is columnar and is positioned between the second compartment 121 and the photoconductor drum 108, adjacent to the opening 125*a*. It is to be noted that "cylindrical" and "columnar" used herein includes polygonal columnar shapes. The development roller 115 parallels both the photoconductor drum 108 and the developer container 117. As described above, the development roller 115 is positioned across the predetermined gap from the photoconductor drum 108. The gap between the development roller 115 and the photoconductor drum 108 serves as the development area 131 where the toner in the developer adheres to the photoconductor drum 108, thus developing the electrostatic latent image formed thereon into a toner image. The development roller 115 faces the photoconductor drum 108 in the development area 131.

The doctor blade 116 is provided in an end portion of the development device 113, on the side of the photoconductor drum 108. The doctor blade 116 is attached to the casing 125 at a position across a gap from the surface of the development sleeve 132. The doctor blade 116 removes the developer from the development sleeve 132 when the amount of the developer is excessive, that is, the thickness exceeds a predetermined thickness, and returns the excessive developer to the developer container 117, thereby adjusting the amount of developer conveyed to the development area 131.

First Embodiment

The development roller 115 according to a first embodiment is described in further detail below.

Figure 3:
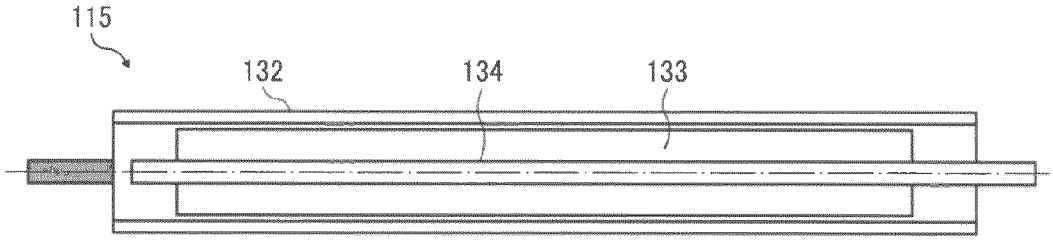
FIG. 3 is a cross-sectional view of a development roller of the development device shown in FIG. 2, along line III-III in FIG. 2.

FIG. 3 is a cross-sectional view of the development roller 115 of the development device 106 shown in FIG. 2, along line III-III in FIG. 2.

As shown in FIGS. 2 and 3, the development roller 115 includes a metal core 134, a cylindrical magnet roller 133 (also "magnet body"), and a hollow, cylindrical development sleeve 132. The metal core 134 is positioned with its long axis in parallel to that of the photoconductor drum 108 and is attached to the casing 125. The metal core 134 does not rotate, that is, its position is fixed relative to the casing 125.

The magnet roller 133 is formed of a magnetic material and cylindrical. Multiple magnets are fixed inside the magnet roller 133, and thus the magnet roller 133 has multiple fixed magnetic poles. The magnet roller 133 is provided outside an outer circumferential surface of the metal core 134. The magnet roller 133 does not rotate, that is, its position is fixed relative to the metal core 134 or the casing 125.

The magnets fixed inside the magnet roller 133 for generating the fixed magnetic poles are shaped like long bars. The magnets extend in the longitudinal direction of the magnet roller 133, that is, the longitudinal direction of the development roller 115, over the entire longitudinal length of the magnet roller 133, for example. The magnet roller 133 is contained inside the development sleeve 132.

One of the multiple fixed magnets (P5 in FIG. 17) faces the agitation screw 118 and generates an attraction pole to attract the developer to the surface of the development sleeve 132. More specifically, a magnetic force generated by the attraction pole on the development sleeve 132, that is, the outer surface of the development roller 115, attracts the developer contained in the second compartment 121 of the developer container 117 to the outer surface of the development sleeve 132.

Another magnet faces the photoconductor drum 108 and generates a development pole that exerts a magnetic force on the outer surface of the development sleeve 132 in the development area 131. Thus, a magnetic field for image development is formed between the development sleeve 132 and the photoconductor drum 108. The magnetic field formed by the development pole causes the developer to form magnetic brushes, thereby transferring the toner of the developer attracted to the surface of the development sleeve 132 to the photoconductor drum 108.

At least one more magnet is present between the magnet generating the attraction pole and that generating the development pole. The magnet or magnets positioned between the attraction pole and the development pole generate a developer conveyance pole that exerts a magnetic force on the development sleeve 132, that is, the outer surface of the development roller 115 for transporting the developer (developer before development) toward the photoconductor drum 108 upstream from the development area 131 and for transporting the developer (developer after development) collected from the photoconductor drum 108 toward the developer container 117.

More specifically, the developer conveyance pole attracts the developer to the outer surface of the development sleeve 132. Then, the magnetic carrier particles contained in the developer stand on end on the development sleeve 132 along the lines of magnetic force generated by the developer conveyance pole. Then, the toner particles are adsorbed to the magnetic carrier particles standing on end on the development sleeve 132. That is, the development sleeve 132 adsorbs the developer to the outer surface thereof with the magnetic force exerted by the magnet roller 133.

In the development device 113, the toner and the magnetic carrier are agitated sufficiently in the developer supply unit 114, and the developer is attracted to the surface of the development sleeve 132 by the magnetic force exerted by the attraction pole. The development sleeve 132 rotates and conveys the developer attracted to the surface thereof by the attraction pole and the conveyance pole to the development area 131. Then, the doctor blade 116 adjusts the amount of the developer carried on the development sleeve 132, and then the developer is attracted to the photoconductor drum 108. Thus, the development device 113 carries the developer on the development roller 115, transports it to the development area 131, and then develops the latent image formed on the photoconductor drum 108 into the toner image.

Further, the development device 113 separates the developer used in image development from the development roller 115 and returns it to the developer container 117. The used developer is agitated with the developer contained in the second compartment 121 of the developer container 117 and is again used to develop the latent image formed on the photoconductor drum 108. It is to be noted that, when the toner concentration detector TD1 detects that the concentration of toner in the developer supplied from the developer supply unit 114 to the photoconductor drum 108 has decreased, the toner supplier 201 supplies fresh toner to the development device 113.

The development sleeve 132 is described in further detail below.

Figure 4:
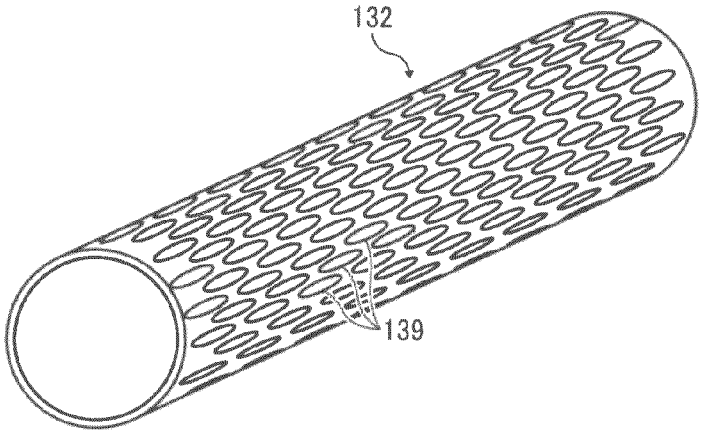
FIG. 4 is a perspective view of a development sleeve of the development device shown in FIG. 2.

FIG. 4 is a perspective view of the development sleeve 132.

As shown in FIG. 4, the development sleeve 132 is cylindrical. The development sleeve 132 containing the magnet roller 133 is supported by the casing 125, for example, rotatably about the axis of rotation so that its inner circumferential surface faces the multiple fixed magnetic poles sequentially. The development sleeve 132 is formed of nonmagnetic material such as aluminum alloy, brass, stainless steel, or electroconductive resin. The surface of the development sleeve 132 is roughened by a surface processing device 1 shown in FIG. 8A.

As the material of the development sleeve 132, aluminum alloy excels in its lightness and easiness in processing. A6063, A5056, and A3003 are preferable as aluminum alloy. When stainless steel is used, SUS303, SUS304, and SUS316 are preferable. In the configuration shown in the figures, the development sleeve 132 is formed of aluminum alloy.

In the present embodiment, the development sleeve 132 has an external diameter of about 18 mm. The axial length of the development sleeve 132 is within a range of from about 300 mm to 350 mm when the maximum sheet size that the image forming apparatus 101 accommodates is A3 size.

Figure 5:
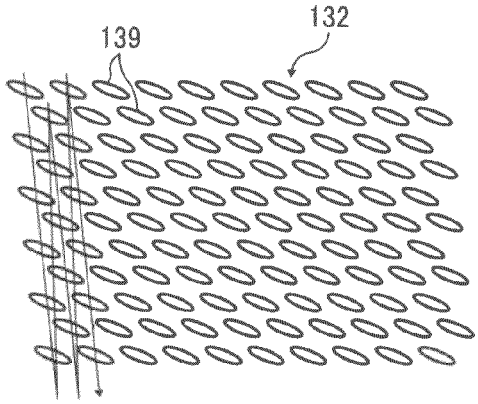
FIG. 5 is a schematic developed view of a surface of the development sleeve partly.

FIG. 5 is a developed view that illustrates the surface of the development sleeve 132.

As shown in FIGS. 4 and 5, multiple recesses 139 are formed in the outer surface of the development sleeve 132, and each recess 139 is oval in the plan view. In the configuration shown in FIGS. 4 and 5, the multiple recesses 139 are regularly arranged on the surface of the development sleeve 132 not to overlap each other. It is to be noted that "regularly arranged" used in this specification means that intervals between adjacent recesses 139 in the circumferential direction are identical, and intervals between adjacent recesses 139 in the longitudinal direction of the development sleeve 132 are identical.

Additionally, each recess 139 is positioned with its long axis along the longitudinal direction of the development sleeve 132. That is, the long axis of each recess 139 is in parallel or substantially parallel to the longitudinal direction of the development sleeve 132. In the configuration shown in FIGS. 4 and 5, the long axis of each recess 139 is slightly oblique to the longitudinal direction of the development sleeve 132 and thus substantially parallels the longitudinal direction of the development sleeve 132. Thus, the long axis of each recess 139 is considered to be "parallel or substantially parallel to the longitudinal direction of the development sleeve 132" in this specification even if slightly oblique to it.

Figure 6A:
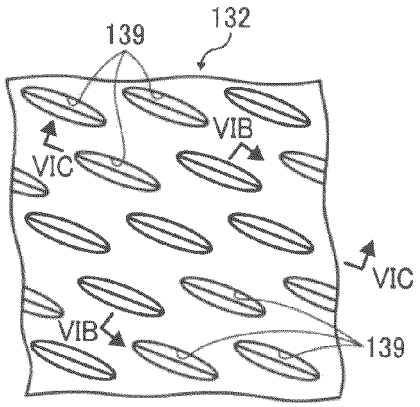
FIG. 6A is a schematic view that illustrates the surface of the development sleeve partly.
Figure 6B:
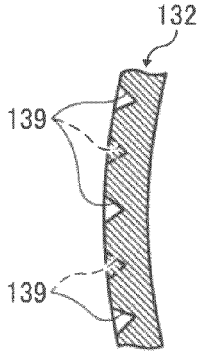
FIG. 6B is a cross-sectional view of the development sleeve along line VIB-VIB shown in FIG. 6A.
Figure 6C:
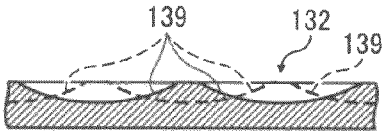
FIG. 6C is a cross-sectional view of the development sleeve along line VIC-VIC shown in FIG. 6A.

FIG. 6A is a schematic view that illustrates the surface of the development sleeve partly, and FIGS. 6B and 6C are cross-sectional views of the development sleeve along line VIB-VIB and that along line VIC-VIC shown in FIG. 6A, respectively.

As shown in FIG. 6A, two adjacent recesses 139 in the circumferential direction of the development sleeve 132 are shifted from each other in the longitudinal direction by about half the longitudinal length of each recess 139 or half a length of each recess 139 in the longitudinal direction of the development sleeve 132. Moreover, the recesses 139 are aligned with a spiral line shown in FIG. 5 since the recesses 139 are formed by the surface processing device 1 shown in FIG. 8A in the surface of the development sleeve 132.

Figure 7:
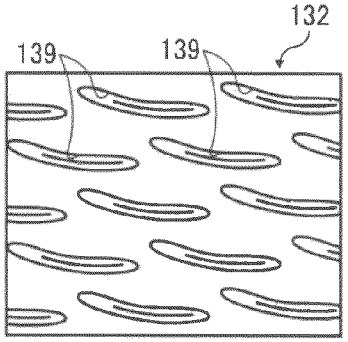
FIG. 7 is a schematic enlarged view that partly illustrates the surface of the development sleeve shown in FIG. 4.

Additionally, the recesses 139 are V-shaped in its width direction or the circumferential direction of the development sleeve 132 as shown in the cross-sectional view shown in FIG. 6B and are arc-shaped in its longitudinal direction or the longitudinal direction of the development sleeve 132 as shown in the cross-sectional view shown in FIG. 6C. Since the recesses 139 are formed by the surface processing device 1 shown in FIG. 8A in the surface of the development sleeve 132, the recesses 139 are slightly arched in the longitudinal direction in the plan view as shown in FIG. 7. It is to be noted that the term "oval" used in this specification includes both shapes that are straight in the longitudinal direction (long axis) and those curved in the longitudinal direction, as long as the longitudinal length is longer than the width and the outline is curved.

In the present embodiment, the recesses 139 have a longitudinal length of from 1.0 mm to 2.3 mm (1.0 mm and 2.3 mm included), a width of from 0.3 mm to 0.7 mm (0.3 and 0.7 mm included), and a depth of from 0.05 mm to 0.15 mm (0.05 mm and 0.15 mm included). The number of the recesses 139 is from 50 to 250 per an area of 100 $mm^2$ of the surface of the development roller 132. In other words, the cubic capacity (dimension) of the multiple recesses 139 in total is from 0.5 $mm^3$ to 7.0 $mm^3$ per an area of 100 $mm^2$ of the surface of the development roller 132. The number of the recesses 139 is 1.0 to 3.0 per 1 mm in the circumferential direction of the photoconductor drum 108 that rotates together with the development roller 132. It is to be noted that the longitudinal direction of the development sleeve 132 is in the lateral direction in FIGS. 5, 6A, and 7.

Although, typically, the developer conveyance ability of the development sleeve 132 increases as the depth of the recesses 139 increases, the amount of developer carried thereon is more likely to become uneven cyclically due to the pitch of the recesses 139 (hereinafter "pitch unevenness in the amount of developer") as the depth of the recesses 139 increases, similarly to grooved development sleeves. By contrast, although unevenness in the amount of developer is alleviated as the depth of the recesses 139 decreases, the developer conveyance ability of the development sleeve 132 also degreases. In particular, at present, pitch unevenness in the amount of developer can occur more frequently since image reproducibility is improved owing to progress in image formation technology, such as introduction of smaller toner particles and magnetic carrier particles and close development. Therefore, in the above-described development sleeve 132, while the depth of the recesses 139 is relatively small, the distribution density of the recesses 139 is increased to balance the developer conveyance ability and prevention of pitch unevenness in the amount of developer carried on the development sleeve 132.

Next, the surface processing device 1 for forming the recesses 139 in the surface of the development sleeve 132 is described below.

Figure 8A:
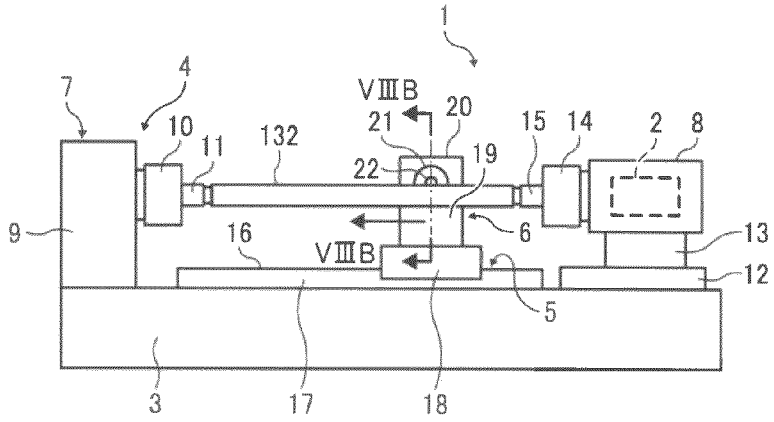
FIG. 8A is a schematic side view of a surface processing device for milling the surface of the development sleeve, thereby forming multiple recesses thereon.

FIG. 8A is a schematic side view of the surface processing device 1 for milling the surface of the development sleeve 132. As shown in FIG. 8A, the surface processing device 1 includes a motor 2 serving as a driving unit, a base 3, a holder 4, a tool transport unit 5, a tool unit 6, and a controller 140.

The base 3 is planar and placed on the floor or a table. An upper face of the base 3 is in parallel to a horizontal direction. The base 3 may be rectangular in a plane view.

The holder 4 includes a fixed holding portion 7 and a slidable holding portion 8. The fixed holding portion 7 includes a fixed pillar 9 standing on an end portion in the longitudinal direction of the base 3 and a rotary chuck 10 provided at an upper end portion of the fixed pillar 9. The rotary chuck 10 is shaped like a thick circular plate and supported by the upper end portion of the fixed pillar 9 rotatably about its center portion. The axis of rotation of the rotary chuck 10 is in parallel to the surface of the base 3, and a columnar chuck pin 11 is positioned in the center portion of the rotary chuck 10 (on the right side of the rotary chuck 10 in FIG. 8A). Needless to say, the chuck pin 11 is coaxial with the rotary chuck 10.

The slidable holding portion 8 includes a slider 12, a slide pillar 13, and a rotary chuck 14 provided at an upper end portion of the slide pillar 13. The slider 12 is slidable along the surface of the base 3, that is, the axis of the chuck pin 11 of the rotary chuck 11. The position of the slider 12 can be fixed in the axial direction of the chuck pin 11 relative to the chuck pin 11 as required.

The slide pillar 13 stands on the slider 12. The rotary chuck 14 is shaped like a thick circular plate and attached to an output shaft of the motor 2 attached to the upper end portion of the slide pillar 13. The center of rotation of the rotary chuck 14 is coaxial with that of the chuck pin 11 of the rotary chuck 10 of the fixed holding portion 7. A columnar chuck pin 15 is provided on a center portion of the rotary chuck 14 (on the left side of the rotary chuck 14 in FIG. 8A). Needless to say, the chuck pin 15 is coaxial with the rotary chuck 14.

In the holder 4, the development sleeve 132 before the recesses 139 are formed is supported between the chuck pins 11 and 15 in a state in which the slidable holding portion 8 is away from the fixed holding portion 7. As the slidable holding portion 8 approaches the fixed holding portion 7, leading edge portions of the chuck pins 11 and 15 enter the end portion of the development sleeve 132. Then, the slider 12 is fixed in position relative to the development sleeve 132 clamped between the chuck pins 11 and 15. Thus, the holder 4 holds the development sleeve 132 between the chuck pins 11 and 15.

The motor 2 is attached to the upper end portion of the slide pillar 13 of the slidable holding portion 8. The motor 2 rotates the rotary chuck 14 about its center portion, thereby rotating the development sleeve 132 supported between the chuck pins 11 and 15 around its axis of rotation.

The tool transport unit 5 includes a linear guide 16 and an actuator (not shown) for transportation. The linear guide 16 includes a rail 17 and a slider 18. The rail 17 is provided on the base 3. The rail 17 is linear. The longitudinal direction of the rail 17 is in parallel to the longitudinal direction of the base 3 as well as the chuck pins 11 and 15, that is, the axial direction of the development sleeve 132 supported between the chuck pins 11 and 15. The slider 18 is supported by the rail 17 slidably in the longitudinal direction of the rail 17.

The actuator for transportation is attached to the base 3 and moves the slider 18 in the longitudinal direction of the base 3 as well as the chuck pins 11 and 15, that is, the axial direction of the development sleeve 132 supported between the chuck pins 11 and 15.

The tool unit 6 includes a tool body 19, a motor 20 serving as a tool rotator, and an end mill 21 serving as a rotary tool. The tool body 19 is shaped like a pillar standing on the slider 18.

Figure 8B:
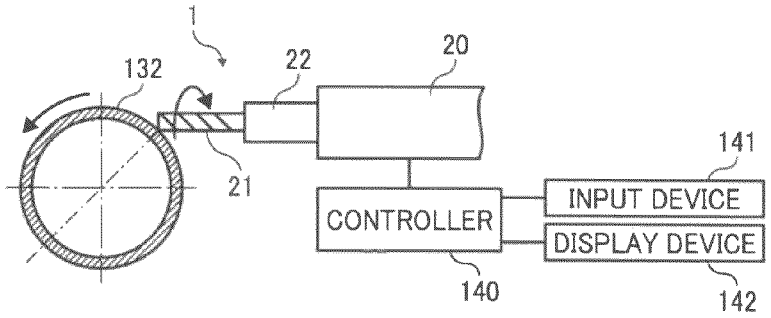
FIG. 8B is a cross-sectional view of the surface processing device along line VIIIB-VIIIB shown in FIG. 8A.

The motor 20 is attached to an upper end portion of the tool body 19. As shown in FIGS. 8A and 8B, an output shaft 22 of the motor 20 projects from the upper end of the tool body 19 toward the development sleeve 132 supported between the chuck pins 11 and 15. The axial direction of the output shaft 22 of the motor 20 is in parallel to the surface of the base 3 and crosses (in FIG. 8B, perpendicular to) the axial direction of the development sleeve 132 supported between the chuck pins 11 and 15.

The end mill 21 is columnar generally and is attached to an end portion of the output shaft 22 of the motor 20. Therefore, the axial direction of the end mill 21 is in parallel to the surface of the base 3 and crosses (in FIG. 8B, perpendicular to) the axial direction of the development sleeve 132 supported between the chuck pins 11 and 15. Additionally, the end mill 21 projects from the upper end of the tool body 19 toward the development sleeve 132 supported between the chuck pins 11 and 15.

Figure 8C:
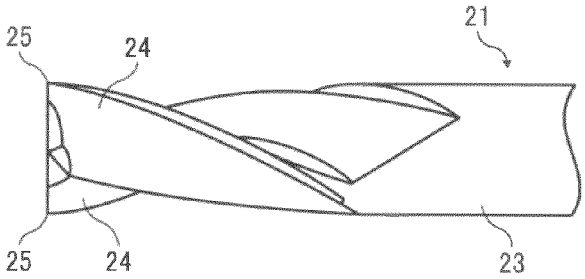
FIG. 8C is an enlarged side view of an end mill shown in FIG. 8B.
Figure 8D:
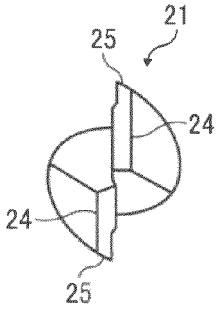
FIG. 8D is a front view of a leading-edge portion of the end mill shown in FIG. 8C.

As shown in FIG. 8C, the end mill 21 includes a columnar main body 23 and two cutting blades 24. The main body 23 is attached to the tool body 19. The cutting blades 24 are provided in an end portion of the main body 23 on the side of the development sleeve 132 at an interval in the circumferential direction. As shown in FIG. 8D, the cutting blades 24 project from an outer rim of the end portion of the main body 23, in the circumferential direction of the main body 23, that is, the end mill 21, and extend spirally. Further, as shown in FIG. 8C, an outer rim 25 of the end portion of each cutting blade 24 is shaped into an acute angle in cross section in the present embodiment.

In the above-described tool unit 6, the motor 20 rotates the end mill 21 around the axis of rotation, thereby forming the recesses 139 in the surface of the development sleeve 132.

The controller 140 of the surface processing device 1 is a computer including a known CPU, a random access memory (RAM), and a read only memory (ROM), for example. The controller 140 is operatively connected to the motor 2, the actuator for transportation of the tool transport unit 5, the motor 20 of the tool unit 6, and controls the surface processing device 1 entirely.

When multiple recesses 139 are formed in the surface of the development sleeve 132, the controller 140 of the surface processing device 1 rotates the development sleeve 132 around its axis of rotation with the motor 2 and moves the tool unit 6 in the axial direction of the development sleeve 132 with the actuator for transportation while rotating the end mill 21 around its axis of rotation with the motor 20. Further, the controller 140 causes the cutting blades 24 to mill, that is, to chip the surface of the development sleeve 132 intermittently as the end mill 21 rotates, thereby forming the multiple recesses 139.

At this time, the radius of the curvature of each recess 139 is determined by the radius of the curvature of the outer rim of the cutting blades 24, and the depth of each recesses 139 is determined by the depth by which the cutting blades 24 chip the surface of the development sleeve 132 (hereinafter "milling amount"). The interval between the recesses 139 in the longitudinal direction of the development sleeve 132 is determined by the velocity at which the tool unit 6 moves. Further, the controller 140 controls the motor 2 serving as the driving source for rotation, the actuator for transportation of the tool transport unit 5, and the motor 20 of the tool unit 6 so that the following formula 1 can be satisfied.

$$N2=N1\times\{[m/(n/2)-0.5]\} \quad (1)$$

wherein N1 represents the rotational number of the development sleeve 132, m represents the number of the cutting blades 24 of the end mill 21.

The controller 140 adjusts those factors as required so as to change the size or arrangement density of the recesses 139. Thus, the surface processing device 1 mills the surface of the development sleeve 132.

Additionally, an input device 141 such as a keyboard and a display device 142 such as a display screen are connected to the controller 140.

Descriptions are given below of a sequence of processes for milling the surface of the development sleeve 132 by the above-described surface processing device 1 for forming the recesses 139.

Initially, an operator inputs the product number of the development sleeve 132 to be processed to the controller 140 via the input device 141. The controller 140 sets the end mill 21 serving as the rotary tool of the tool unit 6 at an initial position, that is, an end portion of the development sleeve 132 in its longitudinal direction, and then holds the development sleeve 132 with the holder 4. At that time, the development sleeve 132 and chuck pins 11 and 15 are positioned coaxially.

Then, the operator instructs the surface processing device 1 to initiate the processing via the input device 141, and the controller 140 drives the motor 2, the actuator of the tool transport unit 5, and the motor 20 of the tool unit 6 based on the above-described formula 1. Then, the cutting blades 24 of the end mill 21 rotate around the axis of rotation and chip the surface of the development sleeve 132 intermittently, thus forming the recesses 139 in the surface of the development sleeve 132. In other words, the recesses 139 are formed in the surface of the development sleeve 132 through milling performed by the tool unit 6 that rotates around its axis of rotation.

Further, because the motor 2, the actuator of the tool transport unit 5, and the motor 20 of the tool unit 6 are driven simultaneously, the development sleeve 132 positioned crossing (in FIG. 8B, perpendicular to) the end mill 21 is also rotated around its axis of rotation when the tool unit 6 rotates around the axis of rotating and mills the surface of the development sleeve 132. While the development sleeve 132 is rotated in this state, the end mill 21 and the development sleeve 132 are moved relative to each other, and thus the recesses 139 are formed.

When the end mill 21 is positioned at a processing completion opposition, that is, the end portion of the development sleeve 132 opposite the initial position and thus milling of the development sleeve 132 is completed, the motor 2, the actuator of the tool transport unit 5, and the motor 20 of the tool unit 6 are stopped. The slidable holding portion 8 is disengaged from the fixed holding portion 7, and the development sleeve 132 in which the multiple recesses 139 are formed is released from the chuck pins 11 and 15, after which another development sleeve 132 is held by the holder 4. Thus, the surface of the development sleeve 132 is processed to form the recesses 139, and the development sleeve 132 shown in FIG. 4 can be produced.

Although blasted (e.g., sandblasted) development sleeve includes projections on their surfaces, on projections are formed on the surface of the development sleeve produced though the above-described process. Further, the recesses 139 formed in the above-described process are relatively large. These features has advantages. For example, the recesses 139 are less likely to wear over time, and accordingly the decrease in the developer conveyance ability can be reduced.

Additionally, the developer can accumulate in the recesses 139 that are positioned regularly not to overlap each other in the surface of the development sleeve 132. That is, the portions where the developer accumulates are arranged regularly, which can prevent or reduce unevenness in the image density. Further, the amount of developer carried on the development sleeve 132 can be increased for maintaining high image quality in high speed image forming apparatuses.

Moreover, the regular arrangement of the recesses 139 can attain the following advantages. The processing conditions can be adjusted easily for balancing expansion of useful life of the development sleeve 132 and increasing the amount of developer carried thereon. The recesses 139 can be formed reliably with the set conditions and processing can be easier.

Further, a sufficient developer conveyance ability can be attained because the multiple recesses 139 are arranged regularly with the long axes of the recesses 139 along the longitudinal direction of the development sleeve 132 and the cubic capacity of the recesses 139 in total is equal to or greater than 0.5 $mm^3$ per an area of 100 $mm^2$ of the surface of the development roller 132.

Since two of the multiple recesses 139 adjacent to each other in the circumferential direction of the development sleeve 132 are shifted from each other in the longitudinal direction thereof, the recesses 139 can extend or be distributed entirely and uniformly. That is, there are no portions where no recesses 139 are present or portions where the recesses 139 are denser than other portions. Therefore, unevenness in the amount of developer attracted to the surface of the development sleeve 132 can be prevented or reduced, thus preventing or reducing unevenness in the image density.

Figure 9A:
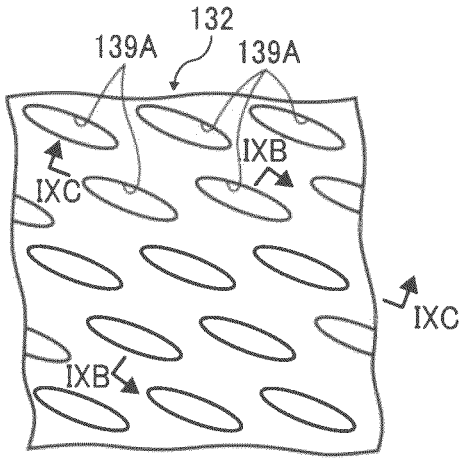
FIG. 9A is a schematic enlarged view that partly illustrates a variation of the recesses formed in the surface of the development sleeve shown in FIG. 6A.
Figure 9B:
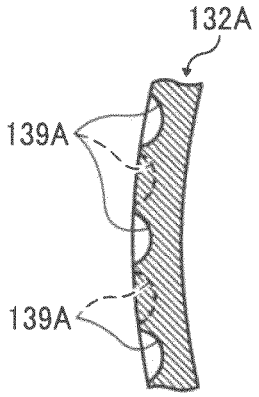
FIG. 9B is a cross-sectional view along line IXB-IXB of the development sleeve shown in FIG. 9A.
Figure 9C:
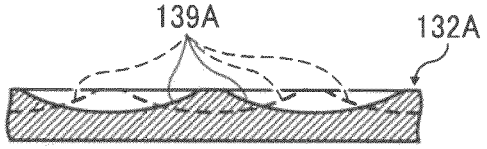
FIG. 9C is a cross-sectional view along line IXC-IXC of the development sleeve shown in FIG. 9A.

Next, variations of the recesses 139 are described below with reference to FIGS. 9A through 9C.

Figure 10:
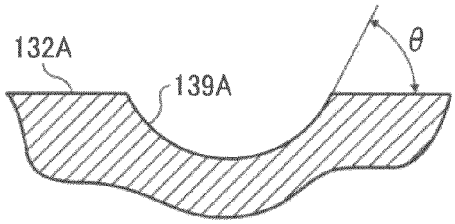
FIG. 10 is an enlarged cross-sectional view of the development sleeve shown in FIG. 9B.
Figure 11:
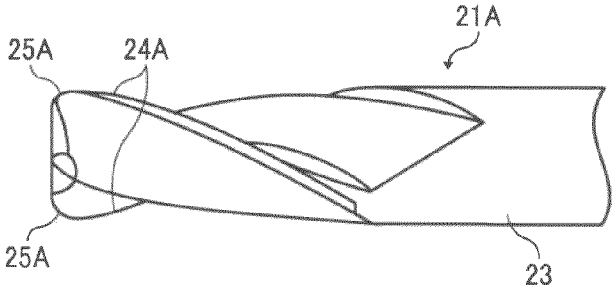
FIG. 11 is an enlarged side view of an end mill for forming recesses in the surface of the development sleeve shown in FIG. 9A.

Although the recesses 139 are V-shaped in cross section in the circumferential direction of the development sleeve 132 as shown in FIG. 6B in the description above, the recesses 139 formed in the development sleeve 132 may have an arc shape in cross section in the circumferential direction of the development sleeve 132. In the configuration shown in FIGS. 9A through 9C, multiple recesses 139A each having an arc shape in cross section in the circumferential direction of a development sleeve 132A are formed in the surface of a development sleeve 132A. In this case, as shown in FIG. 11, an end mill 21A having cutting blades 24A whose outer rims 25A are arc-shaped is used. The cross section of the recesses 139A in the circumferential direction of the development sleeve 132A can be arc-shaped with such cutting blades 24A. Additionally, referring to FIG. 10, it is preferred that an angle θ between the inner face of the recesses 139A in the cross section in the circumferential direction of the development sleeve 132 and circumferential surface of the development sleeve 132 be equal to or less than 60 degrees to alleviate unevenness in the density of developer caused by the effects of the development pole of the magnet roller 133, and this is not limited to the variation shown in FIGS. 9A through 9C. It is to be noted that, portions in FIGS. 9A through 11 similar to those shown in FIGS. 6 through 8D are given identical or similar reference characters, and thus descriptions thereof omitted.

In the case shown in FIGS. 9A through 11, because the recesses 139A are arc-shaped in cross section in both the longitudinal direction and the circumferential direction of the development sleeve 132A, the amount retained in the recesses 139A can be increased. Accordingly, a sufficient amount of developer can be carried on the development sleeve 132A.

Figure 12:
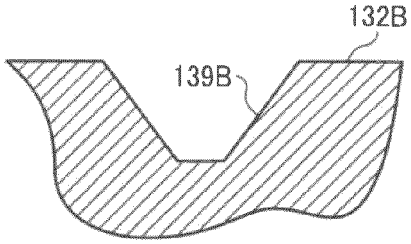
FIG. 12 is an enlarged cross-sectional view that illustrates another variation of the recesses formed in the surface of the development sleeve shown in FIG. 6B.
Figure 13:
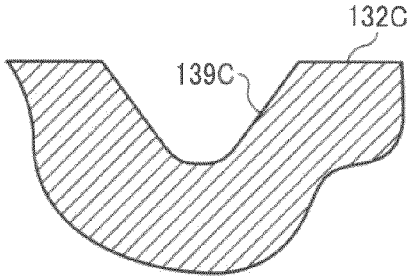
FIG. 13 is an enlarged cross-sectional view that illustrates yet another variation of the recesses formed in the surface of the development sleeve shown in FIG. 6B.

Additionally, although the recesses 139 are V-shaped in cross section in the circumferential direction of the development sleeve 132 as shown in FIG. 6B in the description above, as shown in FIGS. 12 and 13, the cross sectional shape of the recesses 139 in the circumferential direction of the development sleeve 132 may be changed by changing the cross-sectional shape of the outer rim 25 of the cutting blades 24. In FIG. 12, a recess 139B formed in a surface of a development sleeve 132B is substantially V-shaped in cross section and a bottom of the V-shape is flattened. In FIG. 13, a recess 139C formed in a surface of a development sleeve 132C is substantially V-shaped in cross section with a bottom of the V-shape arced.

Figure 14:
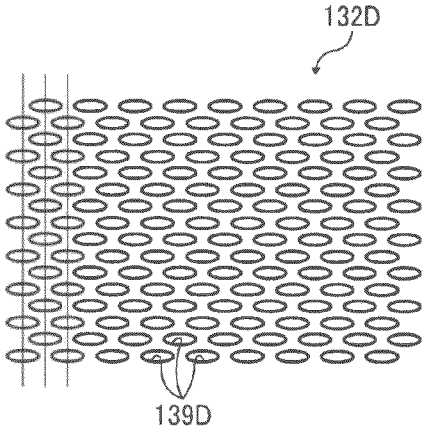
FIG. 14 is a developed view that schematically illustrates a variation of the surface of the development sleeve shown in FIG. 5.
Figure 15:
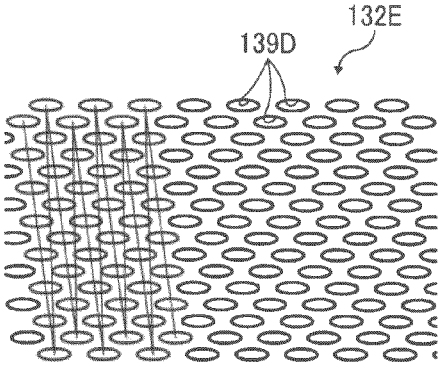
FIG. 15 is a developed view that schematically illustrates another variation of the surface of the development sleeve shown in FIG. 5.

Additionally, although, in the description above regarding FIGS. 6A through 8D, the motors 2 and 20 and the actuator are operated simultaneously and continuously for forming the recesses 139 aligned spirally in the surface of the development sleeve 132 and for shaping each recess 139 slightly arched, alternatively, recesses 139D shown in FIGS. 14 and 15 are linear in the longitudinal direction of the development sleeve 132D and 132E and simultaneously the multiple recesses 139D are aligned linear in the circumferential direction of the development sleeve 132D and 132E by operating the motors 2 and 20 and the actuator intermittently.

Figure 16A:
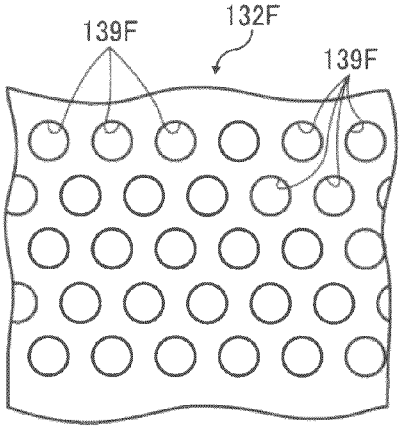
FIG. 16A is a developed view that schematically illustrates yet another variation of the surface of the development sleeve shown in FIG. 5.
Figure 16B:
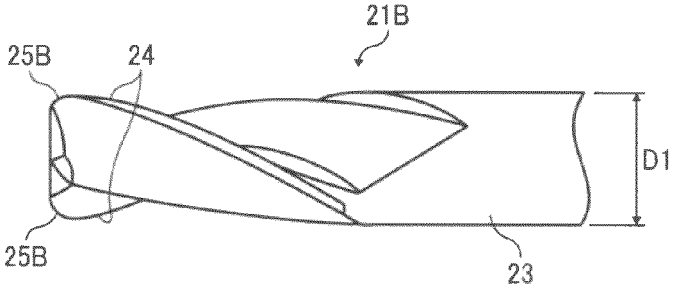
FIG. 16B is an enlarged side view of an end mill for forming the recesses shown in FIG. 16A.

Further, although the recesses 139 are oval in the description above regarding FIGS. 6A through 8D, the shape is not limited thereto. For example, FIG. 16A illustrates circular recesses 139F formed in a surface of a development sleeve 132F in a plan view. Referring to FIG. 16B, the circular recesses 139F can be formed by an end mill 21B having a smaller outer diameter than that of the end mill 21 used for forming the oval recesses 139.

As described above, the image forming apparatus 101 shown in FIG. 1 uses the process cartridges 106 each including the cartridge casing 111, the charge roller 109, the photoconductor drum 108, the cleaning blade 112, and the development device 113. However, it is not necessary to house all of the charge roller 109, the photoconductor drum 108, the cleaning blade 112, and the development device 113 in the cartridge casing 111. The development device 113 and at least one of the charge roller 109, the photoconductor drum 108, and the cleaning blade 112 may be housed together in the cartridge casing 111 of the process cartridge 106. It is to be noted that, not necessary to unite the development device 113 and at least one of the charge roller 109, the photoconductor drum 108, and the cleaning blade 112 as the process cartridge 106. Alternatively, the development device 113 may be independently installed in the image forming apparatus 101.

Next, the magnetic poles of the development device 113 according to the present embodiment are described in further detail below.

Figure 17:
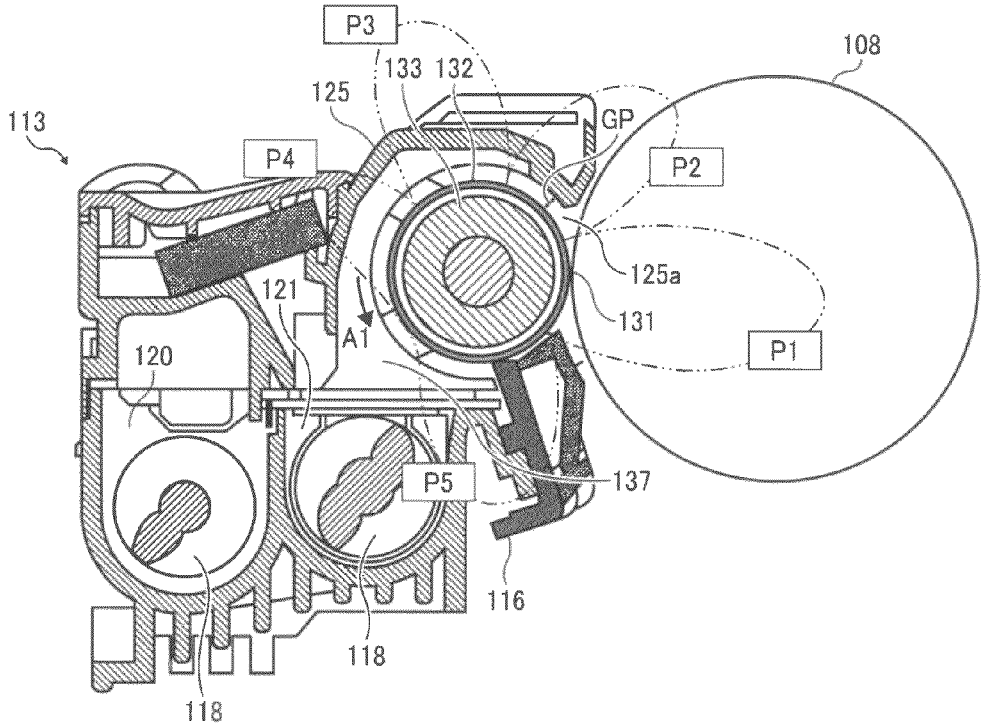
FIG. 17 is a schematic end-on axial view of a development device according to an illustrative embodiment.

FIG. 17 illustrates the development device 113 schematically together with magnetic flux density in the normal direction of the magnet roller 133. As described above, the magnet roller 133 includes the multiple fixed magnetic poles. In FIG. 17, reference characters P1 represents the development pole, P2 and P3 represent the developer conveyance poles, P4 represents the release pole, and P5 represents the attraction pole, positioned downstream from the release pole P4. In the configuration shown in FIG. 17, among the multiple fixed magnetic poles, the developer conveyance poles P2 and P3 or the magnets generating them serve as a magnetic field generator for generating the magnetic field that exerts the force for transporting the developer that has passed through the development area 131 to a developer release portion 137, where the developer is separated from the development sleeve 132.

The development sleeve 132 rotates in the direction indicated by arrow A1 shown in FIG. 17, and the developer in the second compartment 121 is attracted to the surface of the development sleeve 132 by the magnetic force exerted by the magnet roller 133. Subsequently, the amount of the developer is adjusted, that is, the developer on the development sleeve 132 is leveled, by the doctor blade 116, and conveyed to the development area 131, where the photoconductor drum 108 faces the development roller 115 across the gap. Then, the developer develops the latent image formed on the photoconductor drum 108 into a toner image. The developer passes through the opening 125*a* of the casing 125 and is further conveyed to the developer release portion 137 by the magnetic force exerted by the developer conveyance poles P2 and P3, after which the developer is separated from the development sleeve 132 by the release pole P4 and collected in the second compartment 121. In the second compartment 121, the agitation screw 118 agitates and transports the developer.

A predetermined gap is provided between an inner wall of the casing 125 and the outer circumferential surface of the development sleeve 132 at a position downstream form the opening 125*a* and upstream from the developer release portion 137 in the rotational direction of the development sleeve 132. This gap, that is, the distance between the inner wall of the casing 125 and the outer circumferential surface of the development sleeve 132 is hereinafter referred to as a casing gap GP. The magnetic force exerted by at least one of the developer conveyance poles P2 and P3 acts in the casing gap GP.

The casing gap GP is allowed between the development sleeve 132 and the inner wall (i.e., the casing 125) of the development device 113 to prevent scattering of toner. More specifically, the casing gap GP is positioned adjacent to the opening 125*a*, between a surface of the development sleeve 132 and the inner wall where the developer passes after passing through the development area 131. The casing gap GP faces one of the multiple magnetic poles of the magnet roller 133.

The casing gap GP is described in further detail below with reference to FIG. 18 that is an enlarged view around the developer conveyance poles P2 and P3.

Figure 18:
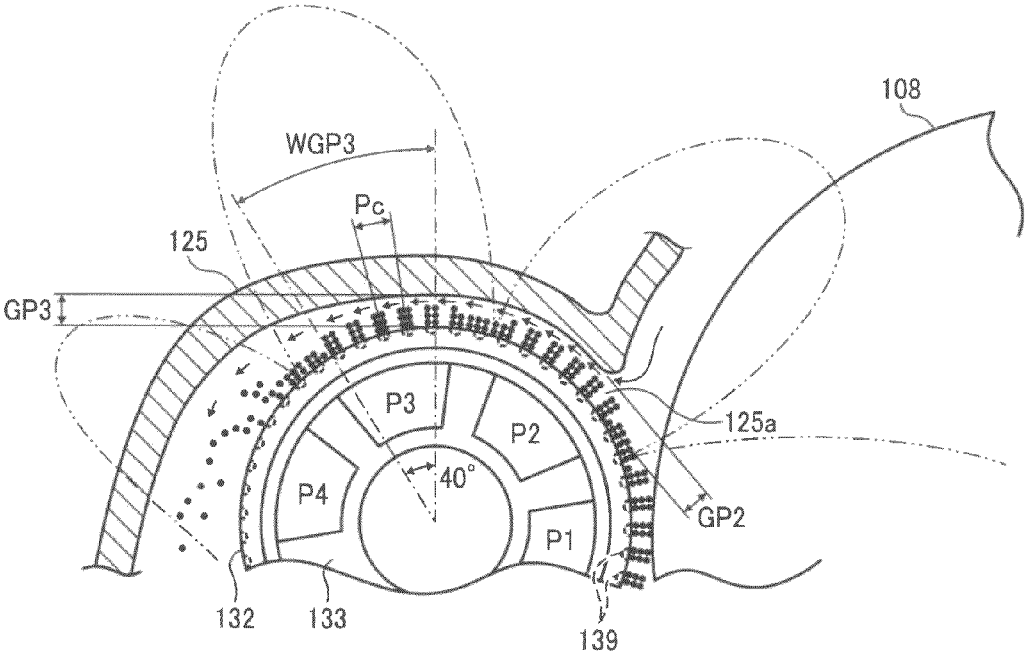
FIG. 18 is an enlarged view that illustrates a configuration around developer conveyance poles P2 and P3 of a magnet roller.

In FIG. 18, for example, the casing gap GP between the inner wall of the casing 125 and the outer circumferential surface of the development sleeve 132 at a position facing the developer conveyance pole P2 is about 1.8 mm (hereinafter "a gap GP2") and at a position facing the developer conveyance pole P3 is about 1.0 mm (hereinafter "a gap GP3").

Providing the above-described casing gap GP can cause an airflow, flowing into the development device 113 (hereinafter "sucking-in airflow"), that transports the developer in the rotational direction of the development sleeve 132 when the developer on the development sleeve 132 passes through the casing gap GP between the inner wall of the casing 125 and the outer circumferential surface of the development sleeve 132. In other words, because the developer stands on end on the development sleeve 132 along the lines of magnetic force generated by the magnet roller 133, an airflow flowing into the development device 113 is caused when the developer standing on end on the development roller 132 passes through the casing gap GP as the development sleeve 132 rotates. The sucking-in airflow can prevent or reduce scattering of toner outside the device.

It is to be noted that, when development sleeves having multiple recesses formed in its surface, such as the development sleeve 132 according to the present embodiment, are used, the intervals between the recesses 139 in the circumferential direction of the development sleeve 132 should be set properly to prevent scatting of toner outside the development device 113. More specifically, retained in the recesses 139, the developer particles stand on end one on another. Therefore, if the interval between the recesses 139 in the circumferential direction of the development sleeve 132 is relatively large, air might leak through gaps between the developer particles standing on end one on another in the recesses 139, thus making it difficult to generate the sucking-in airflow. As a result, toner scatters outside the development device 113.

Additionally, the developer particles stand on end on the surface of the development sleeve 132 along the lines of magnetic force generated by the developer conveyance poles P2 and P3 of the magnet roller 133, and this phenomenon can occur reliably on the surface of the development sleeve 132 corresponding to half a width of the magnetic flux density of the developer conveyance poles P2 and P3 in the direction perpendicular to the longitudinal direction. Therefore, in the present embodiment, an arrangement pitch (interval) Pc of the recesses 139 in the circumferential direction thereof is smaller than a circumferential length of the development sleeve corresponding to the half width of the magnetic flux density of the developer conveyance poles P2 and P3 (hereinafter "the casing gap width").

For example, regarding the developer conveyance pole P3, the arrangement pitch Pc of the recesses 139 in the circumferential direction of the development sleeve 132 is as follows. Referring to FIG. 18, the half width of the magnetic flux density of the developer conveyance pole P2 in the direction perpendicular to the longitudinal direction is about 40 degrees around the axis of the magnet roller 133. Accordingly, when the diameter of the development sleeve 132 is 18 mm, a casing gap width WGP3 is about 6.28 to 6.40 mm. It is preferred that the arrangement pitch Pc of the recesses 139 in the circumferential direction of the development sleeve 132 be smaller than the casing gap width WGP3 so that at least a pair of recesses 139 is present in the casing gap width WGP3. In the present embodiment, considering the safety factor, the arrangement pitch Pc of the recesses 139 in the circumferential direction of the development sleeve 132 is equal to or smaller than 1 mm so that an adequate quantity of recesses 139 is present in the casing gap width WGP3. With this configuration, an adequate amount of sucking-in airflow can be generated, thereby preventing or reducing scattering of toner through the opening 125*a* of the casing 125.

It is to be noted that, although the arrangement pitch Pc of the recesses 139 in the circumferential direction of the development sleeve 132 is set based on the half width of the magnetic flux density of the developer conveyance pole P3 in the direction perpendicular to the longitudinal direction in the description above, alternatively, it can be set based on the half width of the magnetic flux density of the developer conveyance pole P2 in the direction perpendicular to the longitudinal direction. The arrangement pitch of the recesses 139 can be changed by adjusting the variables of the surface processing device 1 shown in FIG. 8A such as the rotational frequency of the bit, the velocity at which the bit is moved, and the rotational velocity of the development sleeve 132.

Figure 19:
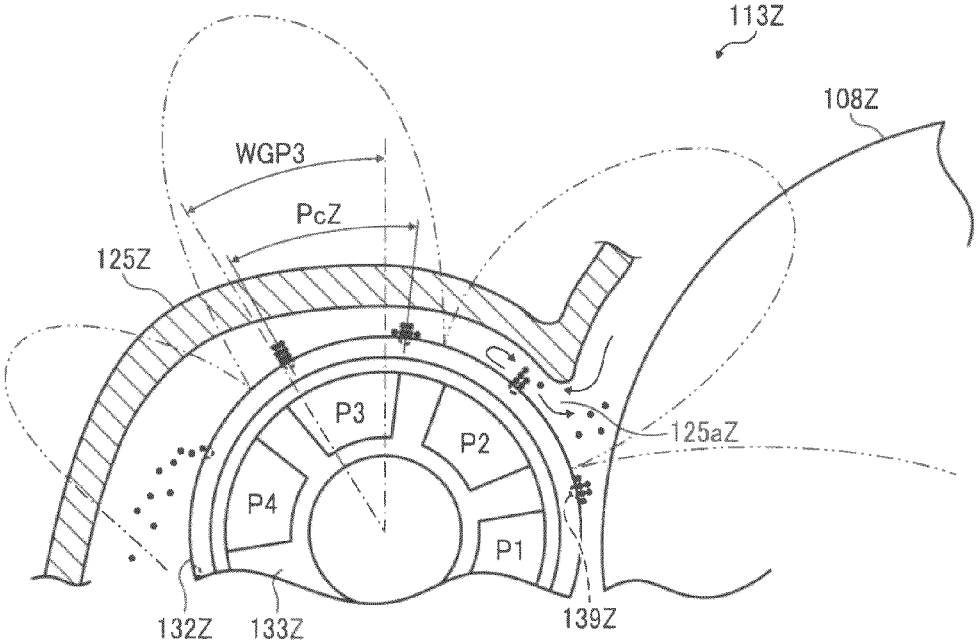
FIG. 19 is an enlarged view that illustrates in a configuration around developer conveyance poles P2 and P3 of a comparative example.

FIG. 19 is a schematic cross-sectional view of a development device 113Z according to a comparative example. In the comparative development device 113Z shown in FIG. 19, the recesses 139Z formed in a surface of a development sleeve 132Z are arranged at an arrangement pitch PcZ greater than the casing gap width WGP3. In this comparative example, because gaps created between the developer particles standing on end one on another in the recesses 139Z are larger, air leaks through such gaps. Consequently, air cannot flow into the development device 113Z. Because the airflow flowing into the development device 113Z is not generated, the toner might leak through the opening 125*a*Z and scatter outside the development device 113Z if insufficiently charged toner is not fully adhere to the carrier and then is separated therefrom.

Figure 20:
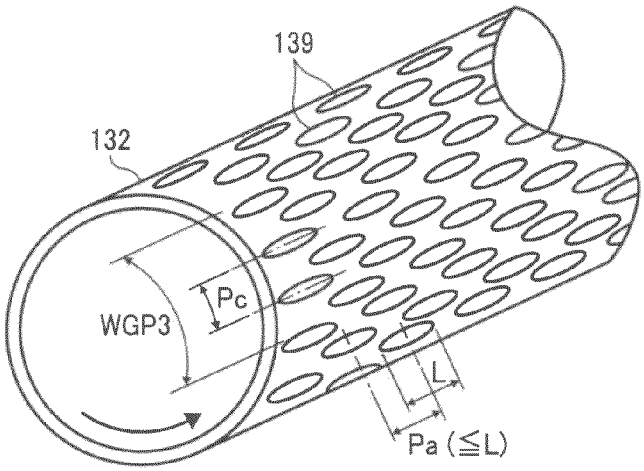
FIG. 20 is an enlarged perspective view of the development sleeve.

FIG. 20 is an enlarged perspective view that partly illustrates the surface of the development sleeve 132 according to the present embodiment. In FIG. 20, the oval recesses 139D shown in FIGS. 14 and 15 (hereinafter simply "recesses 139") are formed in the surface of the development sleeve 132, positioned with their long axes aligned with the axial direction of the development sleeve 132. The recesses 139 are arranged in multiple lines in the circumferential direction of the development sleeve 132, and adjacent recesses 139 are shifted from each other in the circumferential direction.

Additionally, it is preferred that an arrangement pitch Pa between the recesses 139 in the axial direction of the development sleeve 132 be equal to or shorter than a length L of each recess 139 in the axial direction of the development sleeve 132. In other words, adjacent two recesses 139 in the circumferential direction of the development sleeve 132 are shifted from each other in the axial direction of the development sleeve 132, and the amount by which the adjacent recesses 139 are shifted from each other is equal to or shorter than the length L of the recess 139 in the axial direction of the development sleeve 132. With this arrangement, no gap is present in the axial direction of the development sleeve 132 between end portions of two recesses 139 adjacent to each other in the circumferential direction of the development sleeve 132. Therefore, when the development sleeve 132 rotates, in the end portions of two recesses 139 adjacent to each other in the axial direction, no air or little air leak through the gaps between the developer particles standing on end on the recesses 139. Accordingly, an adequate amount of sucking-in airflow can be generated.

Additionally, in the present embodiment, the development device 113 is removably installable in the main body 102 of the image forming apparatus 101, and an airflow flowing from the front side to the back side in the direction in which the development device 113 is installable in the apparatus (hereinafter "installation direction of the development device 113") is generated in the above-described gap between the inner wall of the casing 125 and the outer circumferential surface of the development sleeve 132.

Figure 21:
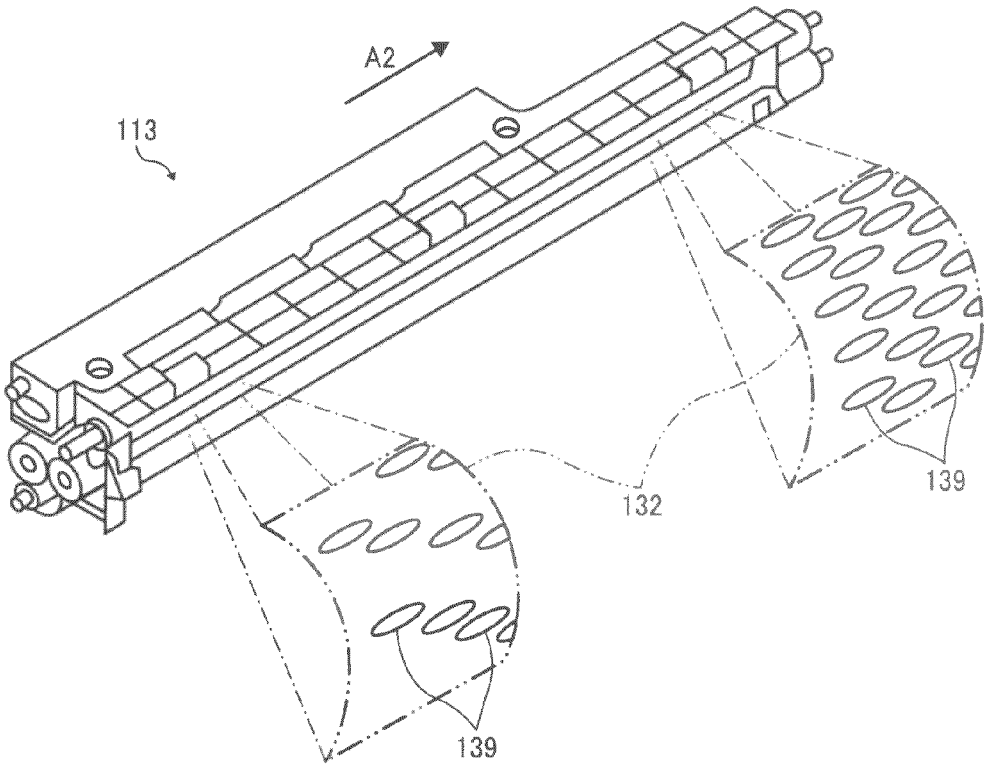
FIG. 21 is a perspective view of the development device in a longitudinal direction thereof.

FIG. 21 is a perspective view of the development device 113 in the longitudinal direction thereof and illustrates changes in the density of the recesses 139. Arrow A2 shown in FIG. 21 represents the installation direction of the development device 113. Portions indicated by broken lines in FIG. 21 are enlarged views of the surface of the development sleeve 132. Although the development device 113 is incorporated in the process cartridge 106 in the present embodiment, alternatively, the development device 113 may be designed to be installed in and removed from the main body 102 of the image forming apparatus 101 independently.

As shown in FIG. 21, the density of the recesses 139 per unit area of the development sleeve 132 is smaller on the front side and increases gradually toward the back side in the installation direction of the development device 113. In other words, the arrangement pitch Pc of the recesses 139 in the circumferential direction is smaller on the back side than the front side in the installation direction of the development device 113. In the configuration shown in FIG. 21, the density of the developer particles standing on end on the recesses 139 is greater on the back side than the front side in the installation direction of the development device 113. Accordingly, the sucking-in airflow generated when the development device 113 rotates is stronger on the back side than the front side. At that time, an airflow flowing from the front side to the back side in the installation direction of the development device 113 (hereinafter also simply "the airflow toward the back side") is generated. Consequently, even if insufficiently charged toner is separated from the carrier adjacent to the opening 125*a* on the front side in the installation direction of the development device 113, the toner can be transported by the airflow toward the back side to the back side portion of the development device 113, thus preventing or reducing scattering of toner outside the development device 113. Consequently, when the service person or the user holds the front side portion of the development device 113 and draws it out for replacement or checkup, toner does not scatter on the front side of the development device 113. Accordingly, the hand of the service person or the user holding the development device 113 can be kept clean.

Additionally, in the present embodiment, to generate the airflow flowing from the front side to the back side in the installation direction of the development device 113 in the gap between the inner wall of the casing 125 and the outer circumferential surface of the development sleeve 132, the oval recesses 139 may be positioned with their long axes oblique to the axial direction of the development sleeve 132.

Figure 22A:
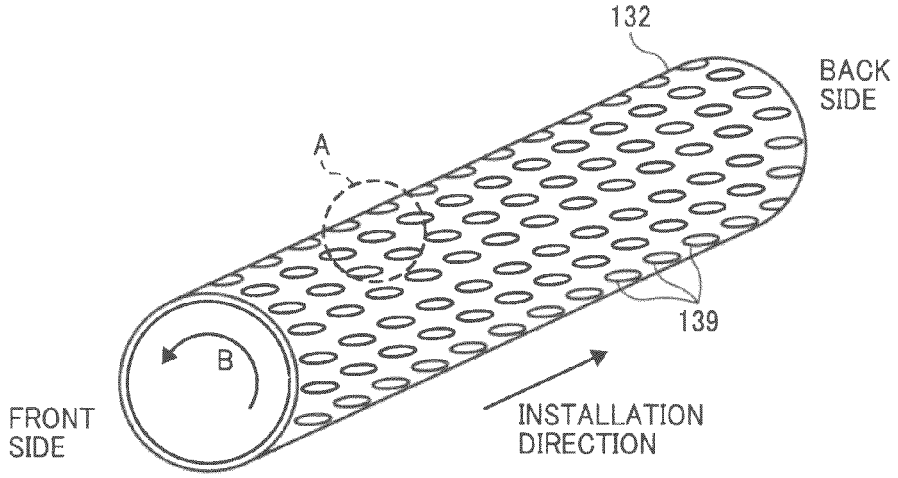
FIG. 22A is a perspective view of the development sleeve 132 in which the recesses 139 are positioned with their long axes oblique to the axial direction of the development sleeve 132.
Figure 22B:
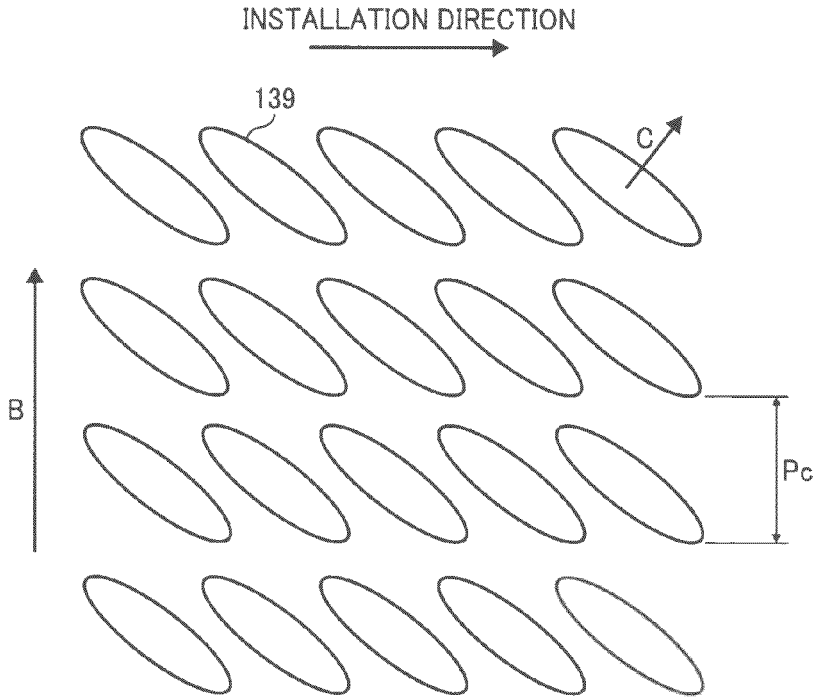
FIG. 22B is an enlarged view of a portion enclosed with a circle A shown in FIG. 22A.

FIG. 22A is a perspective view of the development sleeve 132 in which the recesses 139 are positioned with their long axes oblique to the axial direction of the development sleeve 132, and FIG. 22B is an enlarged view of a portion enclosed with a circle A shown in FIG. 22A.

As shown in FIGS. 22A and 22B, when the development sleeve 132 having the recesses 139 positioned oblique to the axial direction of the development sleeve 132 rotates in the direction indicated by arrow B, an airflow flowing in the direction indicated by arrow C (shown in FIG. 22B) is generated by the developer particles standing on end one on another in the recesses 139. In the developer release portion 137, the developer is separated from the development sleeve 132 in the direction indicated by arrow C toward the back side in the installation direction of the development device 113. Thus, as the development sleeve 132 rotates, the airflow flowing toward the back side in the installation direction of the development device 113 can be generated. Consequently, even if insufficiently charged toner is separated from the carrier adjacent to the opening 125*a* on the front side in the installation direction of the development device 113, the toner can be transported by the airflow to the back side portion of the development device 113, thus preventing or reducing scattering of toner outside the development device 113. In particular, scattering of toner on the front side portion of the development device 113 can be alleviated.

Additionally, shown in FIG. 21, when the density of the recesses 139 per unit area of the development sleeve 132 increases gradually from the front side to the back side in the installation direction of the development device 113, the airflow toward the back side can be stronger.

As described above, an effect of the first embodiment is to reliably generate the airflow to prevent or reduce scattering of toner that occurs when the developer standing on end on the development sleeve passes through the casing gap in a configuration in which multiple recesses are formed at intervals in the surface of the development sleeve.

Therefore, the development device 113 according to the present embodiment includes the development roller 115 serving as the developer carrier, the developer container 117 that contains two-component developer to be carried on the surface of the development roller 115, the doctor blade 116 serving as the developer regulator that adjusts the layer thickness of the developer carried on the development roller 115, and the casing 125 in which the development roller 115, the developer container 117, and the doctor blade 116 are housed. The development roller 115 includes the development sleeve 132 that is a nonmagnetic rotatable hollow cylinder and the magnet roller 133 serving as the magnetic field generator, disposed inside the development sleeve 132. The development roller 115 transports the developer carried on the circumferential surface of the development sleeve 132 due to the magnetic force exerted by the magnet roller 133. The developer in the developer container 117 is attracted onto the development roller 115 due the magnetic force exerted by the magnet roller 133, and then the doctor blade 116 adjusts the amount of the developer carried on the development roller 115. Subsequently, the developer passes through the development area, where the circumferential surface of the development sleeve 132 is partly exposed through the opening 125*a* of the casing 125 and faces the photoconductor drum 108 serving as the latent image carrier, and then in returned to the developer container 117. The magnet roller 133 has the developer conveyance poles P2 and P3 serving as the magnetic field generator for generating the magnetic field that exerts the force for transporting the developer that has passed through the development area 131 to the developer release portion 137, where the developer is separated from the development sleeve 132. The predetermined gap is provided between the inner wall of the casing 125 and the outer circumferential surface of the development sleeve 132 downstream form the opening 125*a* and upstream from the developer release portion 137 in the rotational direction of the development sleeve 132. Further, the multiple recesses 139 are formed in the surface of the development sleeve 132 at intervals. The arrangement pitch Pc of the recesses 139 in the circumferential direction of the development sleeve 132 is shorter than the length WGP3 that is equal to half the width of the magnetic flux density of the developer conveyance pole P3 in the direction perpendicular to the longitudinal direction. With the pitch Pc of the recesses 139 in the circumferential direction thus set, at least two recesses 139 are present in the portion of the development sleeve 132 having a length equal to half the width of the magnetic flux density, and the developer particles contained in the recesses 139 stand on end one on another therein. The developer particles are thus piled one on another in the recesses 139, dividing the casing gap positioned between the circumferential surface of the development sleeve 132 and the inner surface of the casing 125. Accordingly, as the development sleeve 132 rotates, the air held in the divided casing gaps can be transported to the developer container 117. When the air is transported to the developer container 117, a negative pressure is generated in the casing gap, thus generating the sucking-in airflow that flows from the outside the development device 113 through the opening 125*a* into the device, which can prevent or reduce scattering of toner out side the device.

Additionally, adjacent two recesses 139 in the circumferential direction of the development sleeve 132 are shifted from each other in the axial direction of the development sleeve 132, and the amount by which the adjacent recesses 139 are shifted from each other is equal to or shorter than the length L of the recess 139 in the axial direction of the development sleeve 132. With this arrangement, no gap is present in the axial direction of the development sleeve 133 between end portions of two recesses 139 adjacent to each other in the circumferential direction of the development sleeve 132. Therefore, when the development sleeve 132 rotates, air is less likely to leak through the gaps between the developer particles standing on end one on another in the recesses 139 in the end portions of two adjacent recesses 139 in the axial direction. Accordingly, an adequate amount of sucking-in airflow can be generated.

Further, the development device 113 is removably installable in the main body 102 of the image forming apparatus 101 in the axial direction of the development sleeve 132, and the airflow flowing from the front side to the back side in the installation direction of the development device 113 is generated. Therefore, even when toner that is not adsorbed to the carrier but floats in the air adjacent to the opening 125*a* on the front side in the installation direction of the development device 113, the toner can be transported by the airflow flowing to the back side portion of the development device 113, thus preventing or reducing scattering of toner outside the development device 113.

Moreover, the arrangement pitch Pc of the recesses 139 in the circumferential direction is smaller on the back side than the front side in the installation direction of the development device 113. In the configuration shown in FIG. 21, the density of the developer particles standing on end on the recesses 139 is greater on the back side than the front side in the installation direction of the development device 113. Accordingly, the sucking-in airflow generated when the development device 113 rotates is stronger on the back side than the front side, and the air flows from the front side to the back side in the installation direction of the development device 113.

Additionally, in the present embodiment, each recess 139 is ellipsoidal or oval, and the long axis of the recess 139 is oblique to the axial direction of the development sleeve 132. In particular, the angle of the recess 139 relative to the axial direction of the development sleeve 132 is determined so as to generate the airflow flowing from the front to the back in the installation direction of the development device 113. More specifically, as shown in FIGS. 22A and 22B, to generate such as an airflow, the recess 139 is positioned so that the longitudinal end (back end) of the recess 139 on the back side in the direction in which the development device 113 is installed is tilted upstream in the direction indicated by arrow B, in which the development sleeve 132 rotates from the other end (front end) of the recess 139.

As the development sleeve 132 rotate, the air flows from the front to the back in the installation direction of the development device 113 by the developer particles standing on end one on another in the recesses 139. In the developer release portion 137, the developer is separated from the development sleeve 132 toward the back side in the installation direction of the development device 113. Thus, as the development sleeve 132 rotates, the airflow flowing toward the back side in the installation direction of the development device 113 can be generated.

Second Embodiment

A development roller 115-1 according to a second embodiment and a development device 113-1 including it is described below.

Figure 23A:
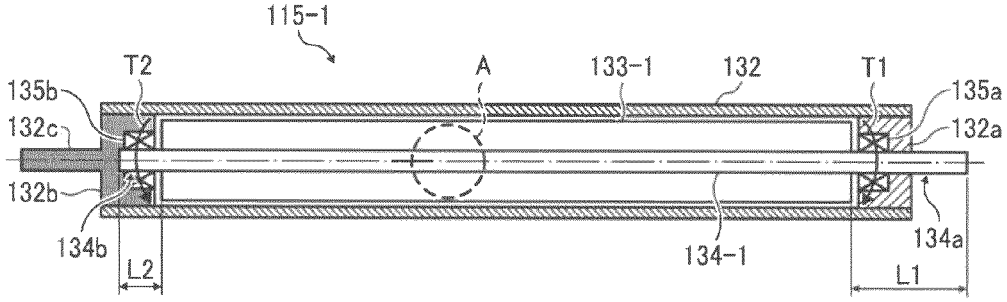
FIG. 23A is a cross-sectional view of the development roller from a side according to the second embodiment.
Figure 23B:
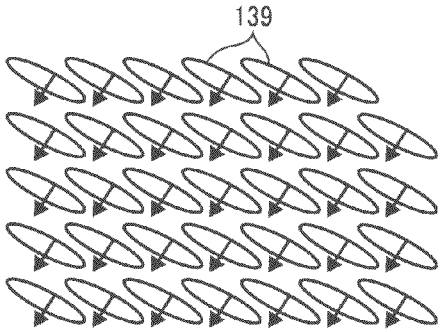
FIG. 23B is an enlarged view of a surface of a development sleeve of the development roller shown in FIG. 23A.
Figure 24:
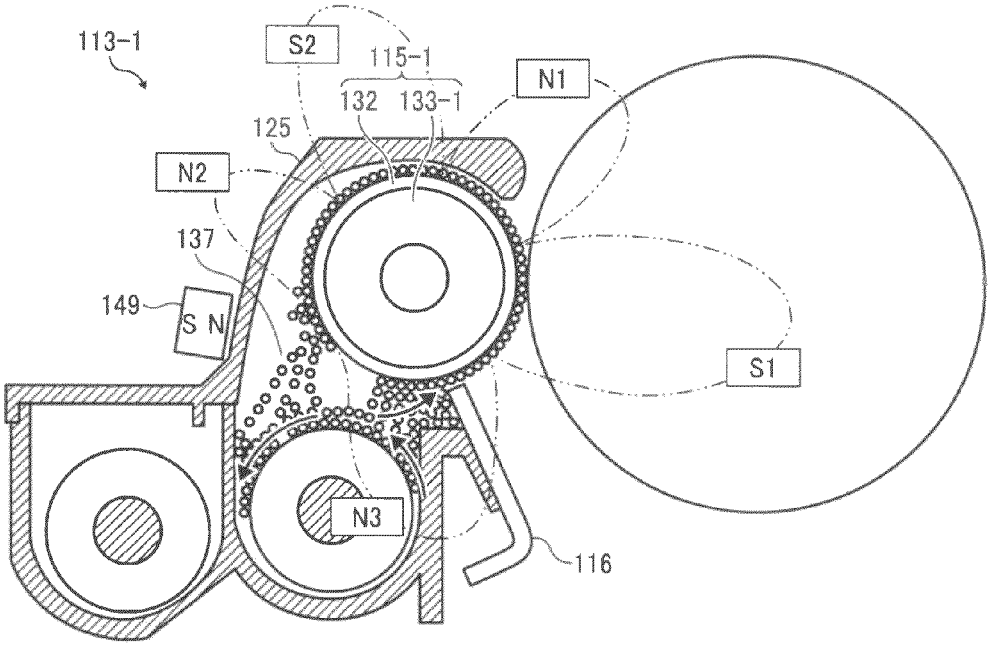
FIG. 24 is an end-on axial view of the development device in which a magnet facing a release pole is provided.

FIG. 23A is a cross-sectional view of the development roller from a side according to the second embodiment, and FIG. 23B is an enlarged view of a surface of a development sleeve of the development roller shown in FIG. 23A. FIG. 24 is an end-on axial view of the development device 113-1.

It is to be noted that components of the development device 113-1 (shown in FIG. 24) similar to those of the development device 113 according to the first embodiment are given identical or similar reference characters, thus omitting descriptions thereof.

The development roller 115-1 shown in FIGS. 23A and 23B is a typical low-cost development roller and includes a development sleeve 132, a magnet roller 133-1, and a magnet roller shaft 134-1. The magnet roller 133-1 is provided outside the magnet roller shaft 134-1 and is fixed thereto not to rotate, and the magnet roller shaft 134-1 is fixed to a casing 125 shown in FIG. 24. The magnet roller 133-1 includes multiple fixed magnetic poles, for example, magnetic poles S1, N1, S2, N2, and N3 arranged in that order in the direction in which the development sleeve 132 rotates, which is counterclockwise in FIG. 24. It is to be noted that, in FIG. 24, reference characters S1, N1, S2, N2, and N3 also represent the magnetic fields generated by the magnetic poles S1, N1, S2, N2, and N3, respectively. The magnetic poles N2 and N3 having an identical polarity generate a magnetic force for separating the developer from the development sleeve 132 after the developer passes through a development area. By adjusting the angle position around the axis of the magnet roller shaft 134-1 fixed to the casing 125, the position of a main pole in the development nip can be determined.

A right end portion 134*a* (second axial end portion) and a left end portion 134*b* (first axial end portion) of the magnet roller shaft 134-1 are provided with bearings 135*a* and 135*b*, respectively, and the bearings 135*a* and 135*b* rotatably support a right flange 132*a* and a left flange 132*b*, respectively. Since the right and left flanges 132*a* and 132*b* are fixed inside both axial end portions of the development sleeve 132, the development sleeve 132 can rotate around the axis of rotation of the magnet roller shaft 134-1 by rotating a rotary shaft 132*c* of the left flange 132*b*.

In FIG. 23A, reference characters L1 and L2 respectively represent a length of the right end portion 134*a* and that of the left end portion 134*b* of the magnet roller shaft 134-1 positioned outside both axial ends (i.e., ends in the longitudinal direction) of the magnet roller 133-1. Because a tip of the right end portion 134*a* of the magnet roller shaft 134-1 is fixed to the casing 125, the length L2 of the left end portion 134*b* is shorter than the length L1 of the right end portion 134*a*.

The magnet roller shaft 134-1 is formed of a magnetic metal material. Thus, the right end portion 134*a* and the left end portion 134*b* of the magnet roller shaft 134-1, positioned outside axial edge faces of a main body of the magnet roller 133-1 are different in length. In the configuration shown in FIG. 23A, the right end portion 134*a* is longer than the left end portion 134*b*. The difference in length between the right end portion 134*a* and the left end portion 134*b* makes the distribution of magnetic field different between the portions of the development sleeve 132 facing the magnetic pole N2 positioned upstream from a developer release portion 137 and the magnetic pole N3 positioned downstream from the developer release portion 137, serving as an attraction pole, in the both axial end portions of the magnet roller 133-1. Therefore, a magnetic field T1 corresponding to the right end portion 134*a* (hereinafter "right-end magnetic field T1") including magnetic fields flowing into it is shaped like a large arc compared with a magnetic field T2 corresponding to the left end portion 134*b* (hereinafter "left-end magnetic field T2"). Therefore, the degree of margin for the occurrence of carry-over of developer is lower in the right end portion of the development sleeve 132 than the left end portion thereof. "Carry-over of developer" is a phenomenon of the developer that is not separated from the development sleeve 132 in the release portion 137 but is carried further by the development sleeve 132. If the developer after image development in which the concentration of toner is decreased is not returned to the developer container but is carried over and supplied again to the development area, image density can become uneven.

In the present embodiment, multiple recesses 139 are formed in the surface of the development sleeve 132, and each recess 139 is positioned oblique to the axial direction of the development sleeve 132 considering the effects of the right-end magnetic field T1 and the left-end magnetic field T2. More specifically, as shown in FIG. 23B, in the developer release portion 137, the angle of the short side of the recess 139 (e.g., a centerline of the recess 139 perpendicular to its long axis) relative to the axial direction of the development sleeve 132 is set so that the developer is separated from the development sleeve 132 toward the left end portion 134*b* of the magnet roller shaft 134-1, which is positioned outside the end of the magnet roller 133-1 in the longitudinal direction thereof and is shorter than the right end portion 134*a*. In other words, in the configuration shown FIGS. 23A and 23B, the left side of each recess 139 on the same side as the shorter left end portion 134*b* of the magnet roller shaft 134-1 (first side) is positioned upstream in the direction in which the development sleeve 132 rotates from the right end thereof on the same side as the longer right end portion 134*a* (second side) for moving the developer in the axial direction of the development sleeve 132 toward the first side on which the end portion (left end portion 134*b*) of the magnet roller shaft 134-1 is shorter, as the developer carrier rotates. With this configuration, in the left end portion of the development roller 115-1, the developer is directed inside the imaging area, that is, to the right in FIG. 23A, and falls from the development sleeve 132, affected by the left-end magnetic field T2 around the left end portion 134*b*. By contrast, in the right end portion of the development roller 115-1, where the degree of margin for the occurrence of carry-over of developer is lower due to the effects of the right-end magnetic field T1 around the right end portion 134*a*, the developer is separated from the development sleeve 132 in the direction indicated by arrows shown in FIG. 23B and falls toward inside the imaging area, that is, to the left in FIG. 23A.

Herein, when multiple oval recesses 139 each positioned oblique to the axial direction of the development sleeve 132 are formed in the surface of the development sleeve 132 as described above, the developer might accumulate on the downstream side (the left side in FIG. 23A in the direction in which the developer is move by the recesses 139. Further, because the developer separated from the development sleeve 132 in the developer release portion 137 is moved toward one end of the development sleeve 132, it is possible that the developer is not separated from the development sleeve 132 but moves to the end portion and then is carried over as the development sleeve rotates 132 (carry-over of developer).

In view of the foregoing, the second embodiment further includes a second magnetic field generator for preventing carry-over of developer, thus alleviating unevenness in the image density while keeping the apparatus relatively compact.

More specifically, as shown in FIG. 24, the development device 113-1 further includes a magnet 149 serving as the second magnetic field generator, positioned facing the developer release portion 137 or the release pole of the magnet roller 133-1. In the configuration shown in FIG. 24, the magnet 149 is attached to the outer surface of the casing 125. Although the description above concerns a low-stress type development device in which a single magnetic pole serves as both the attraction pole to attract the developer onto the development sleeve 132 and a developer regulation pole to adjust the amount of the developer carried on the development sleeve 132 in the configuration shown in FIG. 24, similar effects can be attained when the magnet 149 is provided in development devices, such as the comparative example shown in FIG. 19, in which separate two magnetic poles respectively serve as the attraction pole and the developer regulation pole and is positioned similarly to that shown in FIG. 24.

Figure 25A:
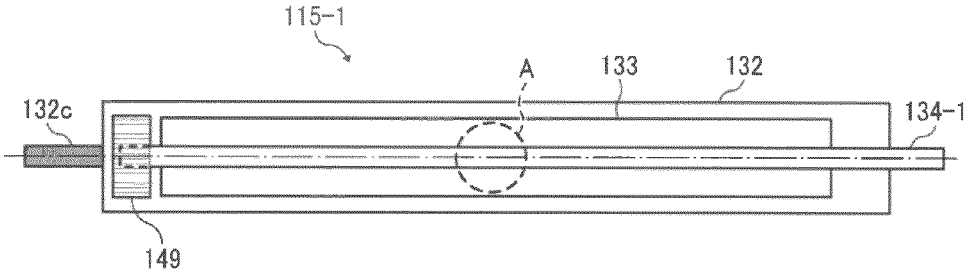
FIG. 25A is a cross-sectional view from a side of a development roller that illustrates the position of the magnet shown in FIG. 24, in the axial direction of the development sleeve.
Figure 25B:
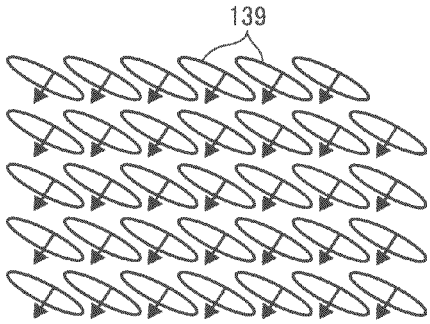
FIG. 25B is an enlarged view of a surface of the development sleeve.

The magnet 149 is positioned facing the magnetic poles N2 and N3 of the magnet roller 133-1, serving as the developer release poles, via the development sleeve 132 with the north pole of the magnet 149 facing the development roller 115-1. Further, as shown in FIG. 25A, the position of the magnet 149 relative to the axial direction of the development sleeve 132 is outside the left end of the magnet roller 133-1 in its longitudinal direction. More specifically, the magnet 149 is positioned facing the developer release portion and in one of the axial end portions of the development sleeve 132 where the force for transporting the developer in the axial direction is generated due to the recesses 139 as shown in FIG. 25B.

Therefore, carry-over of developer in the left axial end portion of the development sleeve 132 can be reduced, and accordingly the longitudinal length of the development roller 115-1 can be reduced.

Figure 26:
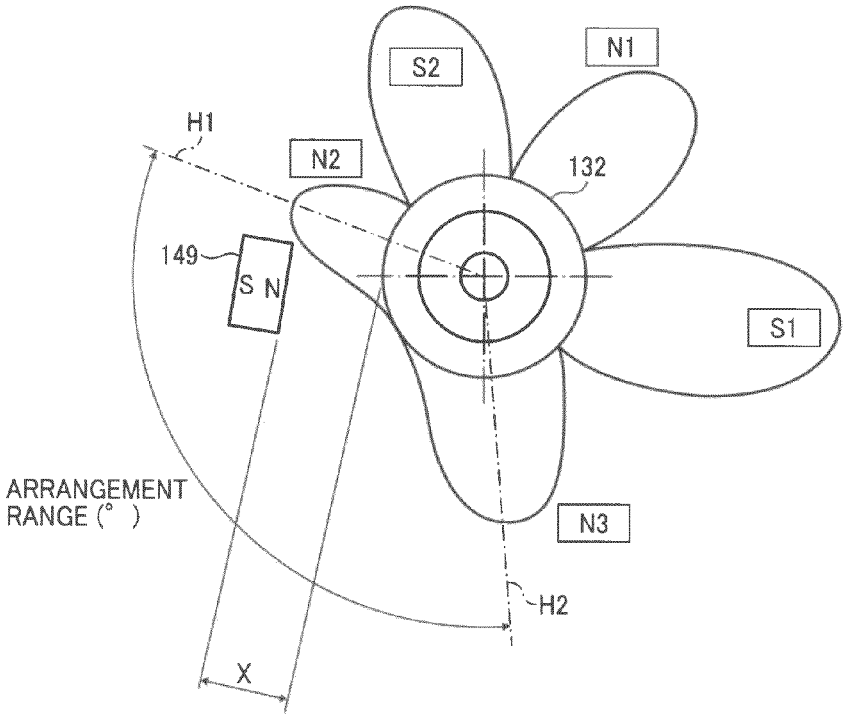
FIG. 26 is a schematic view that illustrates the relation between the distribution of magnetic force on the surface of the development sleeve and the range in which the magnet extends in the direction in which the development sleeve rotates.

FIG. 26 is a schematic view that illustrates the relation between the distribution of magnetic force on the surface of the development sleeve 132 and an arrangement range (angle range) in which the magnet 149 extends in the direction in which the development sleeve transports the developer.

Referring to FIG. 26, the magnet 149 extends, in the developer conveyance direction (rotational direction) of the development sleeve 132, from a normal line H1, passing through a maximum density point of the magnetic flux generated by the magnetic pole N2 on the surface of the development sleeve 132 in the normal direction, to a normal line H2, passing through a maximum density point of the magnetic flux generated by the magnetic pole N3 on the surface of the development sleeve 132 in the normal direction.

It is to be noted that, in the comparative example shown in FIG. 19, in which separate magnetic poles respectively serve as the attraction pole and the developer regulation pole, the arrangement range of the magnet 149 in the developer conveyance direction of the development sleeve 132 is from a normal line passing through a maximum density point of the magnetic flux generated by the magnetic pole S2 on the surface of the development sleeve 132 in the normal direction to a normal line passing through a maximum density point of the magnetic flux generated by the magnetic pole S3 in the normal direction.

The magnetic poles N2 and N3 serving as the developer release poles generate lines of magnetic force for separating the developer from the development sleeve 132, and the magnet 149 generates a magnetic field for deflecting the lines of magnetic force, among those generated by the magnetic poles N2 and N3 in the developer release portion 137, that pass through the axial end portion to the inner side in the axial direction of the development sleeve 132. More specifically, with its side whose polarity is identical to polarity (north) of the magnetic poles N2 and N3 facing the development sleeve 132, the magnet 149 is positioned, in the developer conveyance direction of the development sleeve 132 (rotational direction of the development sleeve 132), within a area from the normal line H1, passing through the maximum density point of the magnetic flux generated by the magnetic pole N2 on the surface of the development sleeve 132 in the normal direction, to the normal line H2, passing through the maximum density point of the magnetic flux generated by the magnetic pole N3 on the surface of the development sleeve 132 in the normal direction. The magnet 149 is positioned outside the body of the magnet roller 133-1 in the axial direction of the development sleeve 132. With this arrangement, as described above, in the release portion 137 on the development sleeve 132, in the area facing the magnet roller 133-1, the direction of the lines of magnetic force in the axial end portion can be deflected close to the direction perpendicular to the axial direction of the development sleeve 132, that is, to such a direction for dropping the developer from the development sleeve 132. Because the force for separating the developer from the development sleeve 132 in the axial end portion can be increased, the developer can be efficiently separated from the surface of the development sleeve 132 in the axial end portion. Consequently, the axial length (i.e., width) of area facing the magnet roller 133 in which the developer is likely to be carried over can be reduced. Therefore, even when the axial length of the area facing the magnet roller 133-1 is reduced, unevenness in image density caused by carry-over of developer can be smaller. Thus, development device can be more compact in the axial direction of the development sleeve 132.

Additionally, as shown in FIG. 26, the magnet 149 is positioned so that a shortest distance X between the N-pole side of the magnet 149 and the outer circumferential surface of the development sleeve 132 is greater than the height (i.e., layer thickness) of developer carried on the circumferential surface of the development sleeve 132 at the position where the distance between the N-pole side of the magnet 149 and the outer circumferential surface of the development sleeve 132 is shortest. This arrangement can prevent the magnetic force exerted by the magnet 149 from hitting the developer carried on the development sleeve 132 when the development sleeve 132 rotates, and desired effects can be maintained.

Figure 27:
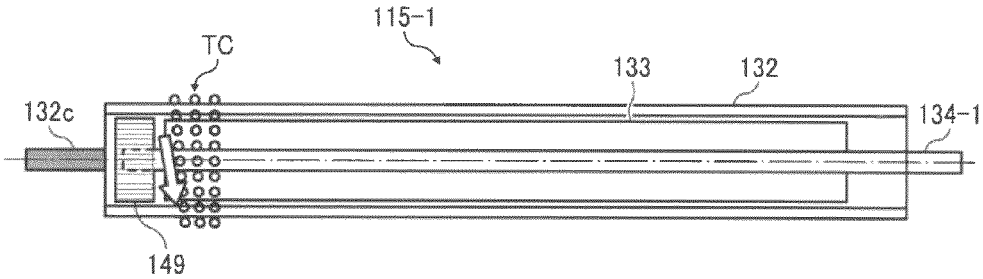
FIG. 27 is a side view of the development roller and illustrates flow of developer in a left end portion of the development sleeve, deflected by the magnet.

FIG. 27 is a side view of the development roller 115-1 and illustrates flow of developer in the left end portion of the development sleeve 132 deflected by the magnet 149. The magnetic force exerted by the magnet 149 can direct developer TC, carried on a surface of the development sleeve 132 positioned outside the left end of the magnet roller 133-1, immediately below that portion or inside the imaging area. Further, the developer TC can be separated from the development sleeve 132 and directed to the developer container by the lines of magnetic force in the normal direction exerted by the magnetic poles N2 and N3 positioned upstream and downstream, respectively, from the developer release portion 137. Thus, carry-over of developer can be alleviated.

It is to be noted that another magnet may be provided in the right end portion of the development device 113-1 in addition to the left end portion in the axial direction of the development sleeve 132.

Figure 28A:
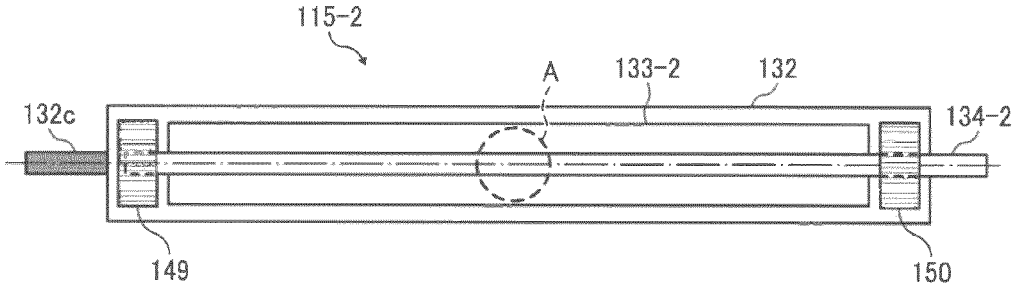
FIG. 28A is a cross-sectional view from a side of a development roller that illustrates position of another magnet in the axial direction of the development sleeve.
Figure 28B:
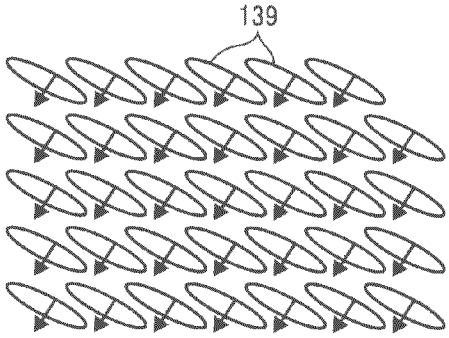
FIG. 28B is an enlarged view of a surface of the development sleeve.

FIG. 28A is a side view of a development roller 115-2 that includes a third magnetic field generator, a magnet 150 positioned in a right end portion outside a right end of a magnet roller 133-2 in addition to the magnet 149. FIG. 28B is an enlarged view of a development sleeve 132 of the development roller 115-2.

Similarly to the development roller 115-1 shown in FIGS. 25A through 27, recesses 139 are formed in the surface of the development sleeve 132 of the development roller 115-2. Carry-over of developer can be better prevented by providing the magnet 150 serving as the third magnetic field generator in addition to the magnet 149.

It is to be noted that the magnetic force of the magnet 149 may be stronger than that of the magnet 150 because, in the left end portion, the force transporting the developer to the left is generated in the developer release portion 137 due to the recesses 139 formed in the surface of the development sleeve 132. The force transporting the developer to the left can be alleviated when the magnetic force of the magnet 149 in the left end portion is stronger than that of the magnet 150. Thus, releasability of the developer from the development sleeve 132 can be substantially equal in the both end portions.

It is to be noted that the above-described features of the embodiments can adapt to other development devices than those shown in the figures.

Third Embodiment

A third embodiment is described below with reference to FIG. 29.

Figure 29:
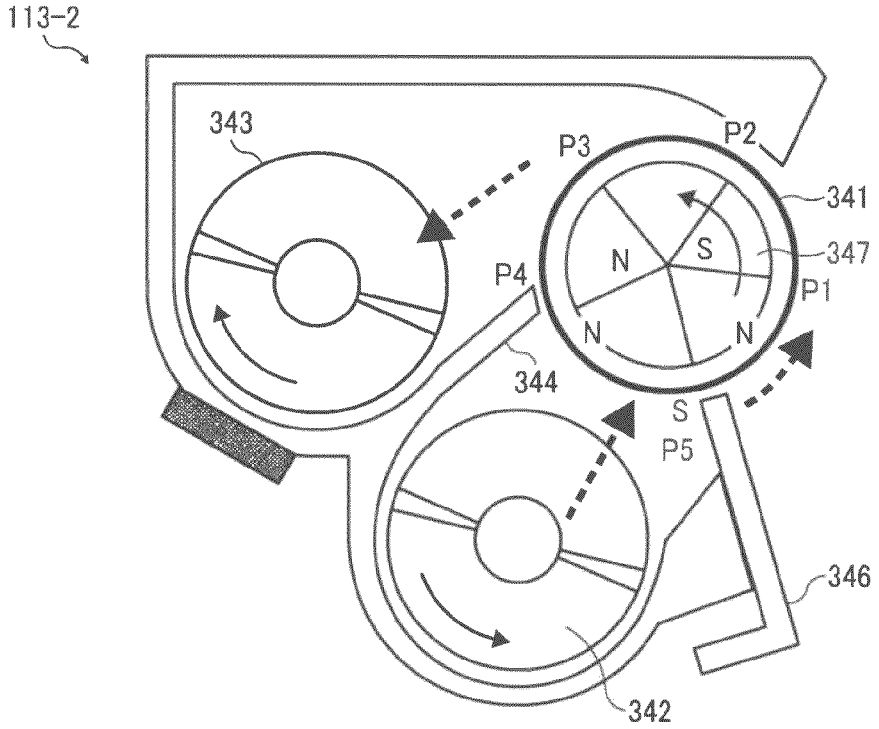
FIG. 29 is an end-on axial view of a development device according to another embodiment.
Figure 30:
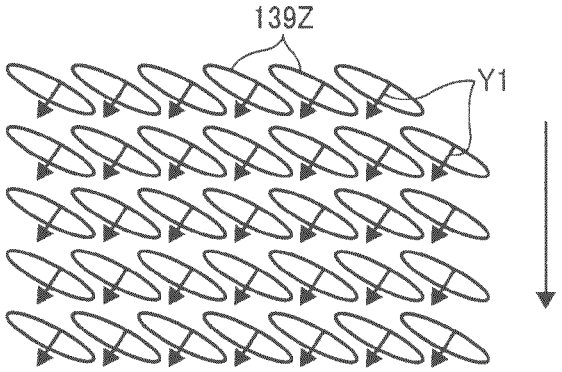
FIG. 30 RELATED ART
FIG. 30 is an enlarged view of a surface of a development sleeve of a related art in which oval recesses are formed, and each recess is tilted with its left end up and its right end down.

FIG. 29 is an end-on axial view of a development device 113-2 according to the third embodiment. The development device 113-2 shown in FIG. 29 includes a developer carrier 341 inside which a magnetic field generator 347 is provided, a developer regulator 346 positioned facing a lower side of the developer carrier 341, and first and second developer conveyance members 342 and 343 to transport the developer contained in a casing of the development device 113-2 in the longitudinal direction of the device. The magnetic field generator 347 generates multiple magnetic poles around the developer carrier 341. The developer regulator 346 adjusts the amount of developer carried on the developer carrier 341. The first developer conveyance member 342 is positioned facing and substantially beneath the developer carrier 341 and supplies the developer to the developer carrier 341 while transporting the developer in the axial direction. The second developer conveyance member 343 is positioned facing the developer carrier 341 and mixes the developer separated from the developer carrier 341 with toner supplied externally. A partition 344 divides an interior of the casing into a compartment in which the first developer conveyance member 342 is disposed and another compartment in which the second developer conveyance member 343 is disposed, and the first and second developer conveyance members 342 and 343 transport the developer unidirectionally. Thus, a developer conveyance path is formed with the partition 344 and the casing. By applying the above-described features of the embodiments to such development devices as that shown in FIG. 29, the degree of margin for carry-over of developer can be enhanced on the side where developer is collected and accordingly the height of developer is higher. Thus, higher effects can be attained.

As described above, an effect of the above-described second and third embodiments is to alleviate carry-over of developer on the surface of the development sleeve, thereby reducing unevenness in image density, while preventing an increase in the size of the device in a configuration in which the developer is moved to one end in the axial direction of the development sleeve due to the oblique recesses formed in the surface of the development sleeve as the development sleeve rotates.

More specifically, the development device according to the second and third embodiments includes the magnet roller shaft 134-1, serving as a magnetic support shaft, that projects outside the both axial ends of the body of the magnet roller 133-1. The magnet roller shaft 134-1 includes the right and left end portions 134*a* and 134*b* of the magnet roller shaft 134-1 of unequal axial length. The left end portion 134*b* on the downstream side in the direction in which the developer in the developer release portion 137 is moved due to the recesses 139 as the development sleeve 132 rotates is shorter than the right end portion 134*a* on the opposite side. With this configuration, in the left end portion of the development roller 115-1, the developer is directed inside the imaging area and falls from the development sleeve 132, affected by the left-end magnetic field T2 around the left end portion 134*b*. In the right end portion of the development roller 115-1, where the degree of margin for the occurrence of carry-over of developer is lower due to the effects of the right-end magnetic field T1 around the right end portion 134*a*, the developer falls from the development sleeve 132 toward inside the imaging area.

Additionally, in the above-described embodiments, toner particles included in the developer have a volume average particle diameter of within a range from 3 μm to 8 μm. Additionally, the ratio of the volume average particle diameter (Dv) to the number average particle diameter (Dn) is within a range of from 1.00 to 1.40 (Dv/Dn). To reproduce fine-dot image greater than 600 dpi, the ratio of the volume average particle diameter (Dv/Dn) is preferably closer to 1.00 for attaining a sharp particle diameter distribution. In the case of toner having such a small diameter and a narrow particle diameter distribution, the distribution of electrical charge can be uniform, and thus high-quality image with scattering of toner in the backgrounds reduced can be produced. Further, in electrostatic transfer methods, the transfer ratio can be improved.

Further, the toner used in the above-described embodiments has a first shape factor SF-1 within a range of from 100 to 180 and a second shape factor SF-2 within a range of from 100 to 180. The toner particle is a sphere when the first shape factor SF-1 is 100. The larger the SF-1 becomes, the more the toner particle becomes amorphous. The toner particle is flat when the first shape factor SF-2 is 100. The larger the first shape factor SF-2 is, the more irregular the toner particle is. When either or both of the first shape factor SF-1 and the second shape factor SF-2 exceed 180, fluidity and circularity of the developer and transfer efficiency may be deteriorated.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device to develop a latent image formed on a latent image carrier with two-component developer consisting essentially of toner and carrier, the development device comprising:

a casing;

a developer container housed in the casing, for containing the developer;

a hollow, cylindrical nonmagnetic developer carrier rotatably disposed within the casing, to transport the developer while rotating, the developer carrier exposed partly through an opening of the casing and facing the latent image carrier in a development area;

a magnetic field generator disposed inside the developer carrier, having multiple magnetic poles including an attraction pole to attract the developer from the developer container to the developer carrier, a developer conveyance pole to keep the developer on the developer carrier downstream from the development area in a direction in which the developer carrier rotates to a developer release portion, and a release pole to separate the developer from the developer carrier and to return the developer to the developer container;

a developer agitator disposed in the developer container, to agitate the developer while transporting the developer in an axial direction of the developer carrier; and a developer regulator housed in the casing, to adjust a layer thickness of the developer carried on the developer carrier, wherein a predetermined gap is kept between an outer circumferential surface of the developer carrier at a position inside which the developer conveyance pole is disposed and an inner wall of the casing at a portion downstream from the opening formed in the casing and upstream from the developer release portion in the direction in which the developer carrier rotates, multiple recesses are formed in the outer circumferential surface of the developer carrier at intervals, and a pitch between adjacent recesses in a circumferential direction of the developer carrier is shorter than half a width of a magnetic flux density of the developer conveyance pole in a direction perpendicular to an axial direction of the developer carrier, wherein the development device is removably installable in an image forming apparatus in a direction parallel to the axial direction of the developer carrier, and wherein each of the multiple recesses formed in the outer circumferential surface of the developer carrier is oval-shaped and is positioned with its long axis oblique to the axial direction of the developer carrier, and in the direction in which the development device is installable in the image forming apparatus, a back end portion of the recess is positioned upstream in the direction in which the developer carrier rotates and a front end portion of the recess is positioned downstream in the direction in which the developer carrier rotates.

2. The development device according to claim 1, wherein adjacent recesses in the circumferential direction of the developer carrier are shifted in the axial direction of the developer carrier a length not greater than a length of the recess in the axial direction of the developer carrier.

3. The development device according to claim 1, wherein the pitch between adjacent recesses in the circumferential direction of the developer carrier is smaller on a back side than a front side in the direction in which the development device is installable in the image forming apparatus for generating an airflow flowing from the front side to the back side of the development device in the direction in which the development device is installable.

4. The development device according to claim 1, wherein the front end portion of the recess is positioned downstream in the direction in which the developer carrier rotates for generating an airflow flowing from the front side to the back side of the development device.

5. A process cartridge removably installable in an image forming apparatus, comprising the development device according to claim 1, wherein the development device and at least one of the latent image carrier, a charging device, and a cleaning device are housed in a common casing.

6. An image forming apparatus, comprising:

the process cartridge of claim 5; and a transfer unit to transfer a toner image developed by the development device to a recording medium.

* * * * *